US006393996B1

(12) United States Patent
Duncan et al.

(10) Patent No.: US 6,393,996 B1
(45) Date of Patent: May 28, 2002

(54) REFINED INTERMODAL VEHICLE FOR FORMING A TRAIN OF HIGHWAY TRAILERS

(75) Inventors: Virgil E. Duncan, Griffin, GA (US); Dominic DiBrito, Silverthorne, CO (US)

(73) Assignee: Rail Runner Systems, Inc., Barnesville, GA (US)

( * ) Notice: Subject to any disclaimer, the term of this patent is extended or adjusted under 35 U.S.C. 154(b) by 0 days.

(21) Appl. No.: 09/556,243

(22) Filed: Apr. 24, 2000

Related U.S. Application Data

(60) Provisional application No. 60/130,565, filed on Apr. 22, 1999.

(51) Int. Cl.[7] ..... B61D 17/00
(52) U.S. Cl. ..... 105/4.2
(58) Field of Search ..... 105/4.2, 4.1, 3

(56) References Cited

U.S. PATENT DOCUMENTS 5,107,772 A * 4/1992 Viens ..... 105/159
5,601,030 A * 2/1997 Brouillette ..... 105/159
6,050,197 A * 4/2000 Wicks ..... 105/4.2
6,123,029 A * 9/2000 Mobley ..... 105/4.1

* cited by examiner

*Primary Examiner*—S. Joseph Morano
*Assistant Examiner*—Robert J. McCarry, Jr.
(74) *Attorney, Agent, or Firm*—John C. Thompson

(57) ABSTRACT

An refined intermodal vehicle for forming a train of highway trailers. The intermodal vehicle has a unitary upper frame assembly provided with leading and trailing load carrying surfaces spaced below ends of a continuous drawbar to which highway trailers may be connected, each of the highway trailers having leading a trailing coupler socket assemblies having vertically spaced apart aligned apertures. In the refined design a coupling pin passes through the continuous drawbar and tightly engages the apertures in the associated coupler socket so that the coupling pin can rock within the drawbar as the associated trailer rocks relative to the upper frame assembly. In addition, the upper frame assembly is mounted on a pair of steerable lower frame assemblies by springs, and an improved steering mechanism is provided. Other features include a centering ramp, a backup coil spring suspension system, a novel stop mechanism. A novel transition vehicle is also provided.

8 Claims, 25 Drawing Sheets

FIG. 4
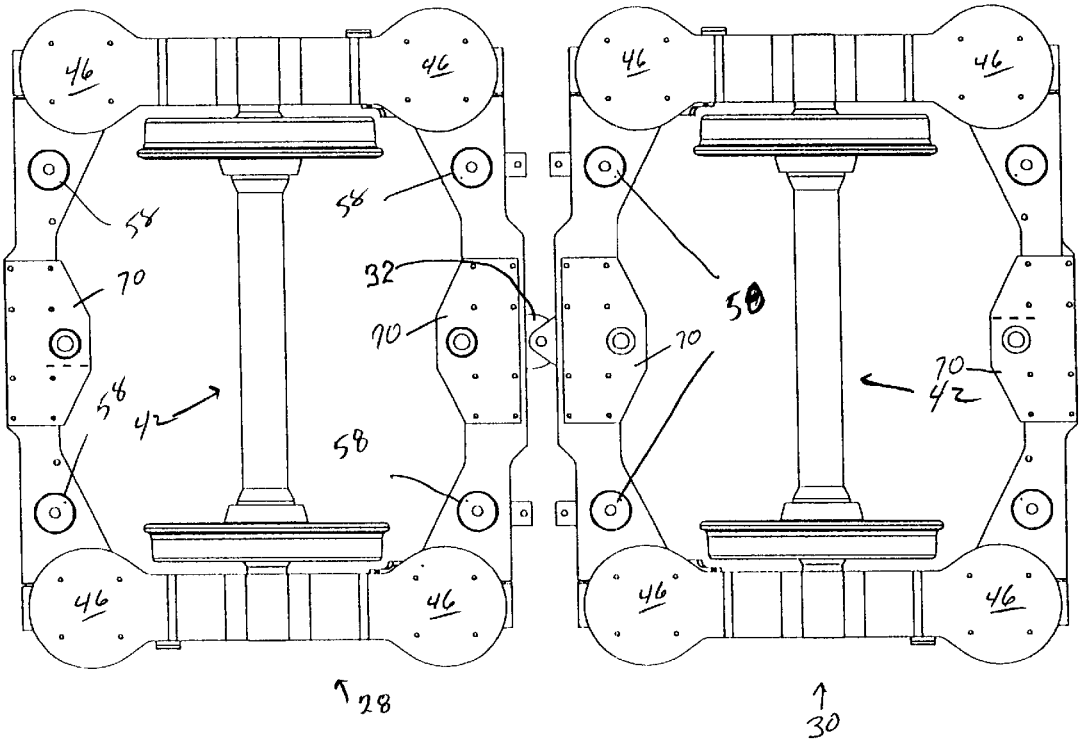
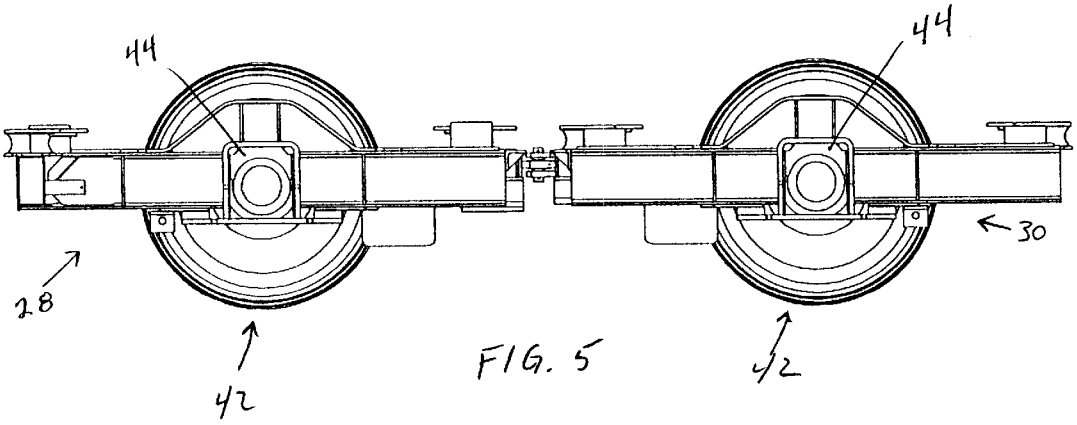
FIG. 5

REFINED INTERMODAL VEHICLE FOR FORMING A TRAIN OF HIGHWAY TRAILERS

This application claims benefit of Provisional No. 60/130,565 filed Apr. 22, 1999.

TECHNICAL FIELD

This invention deals with improvements in intermodal rail vehicles of the type shown in U.S. Pat. Nos. 5,291,835, 5,890,433 and 6,050,197.

BACKGROUND OF THE INVENTION

The above-identified prior art discloses novel intermodal vehicles for use in forming a train of highway trailers including leading and trailing trailers which are interconnected to each other and supported by the intermodal vehicles. The intermodal vehicle of this invention, as well as the prior art referred to above, is intended for use with highway trailers of all configurations, including trailers especially designed to haul so-called "ISO" shipping containers. Each of the highway trailers include a leading coupler socket assembly at the leading end and a trailing coupler socket assembly at the trailing end, each of the socket assemblies being provided with a pair of vertically spaced apart aligned apertures for receiving a coupling pin. The intermodal vehicle is characterized by a lower frame assembly supported by two rail wheel assemblies, and a unitary upper lifting frame assembly supported on the lower frame assembly by spring means. The spring means include air springs which are so arranged that when air is removed from the air springs, the upper lifting frame assembly will descend towards the lower frame assembly, and when air is introduced into the air springs, the upper lifting frame assembly will rise, at the same time raising any highway trailers which may be resting on the upper lifting frame assembly. To this end, the upper lifting frame assembly includes leading and trailing upwardly presented load carrying structures, each of the load carrying structures having an upper trailer support surface for engaging the bottom of a trailer. In addition, a coupler tongue is associated with each of the load carrying structures, the coupler tongue being adapted to be received in the coupler socket assemblies. Each tongue is provided with an aperture for receiving a vertically oriented coupling pin which is carried by each of the load carrying structures. The coupling pin is moveable vertically from a position below the trailer support surface to a position where it passes through the apertured socket assemblies for securing a tongue within the apertured socket assembly. U.S. Pat. No. 5,890,433 discloses that the upper frame assembly may be in two sections, each independently moveable, whereas U.S. Pat. No. 5,291,835 discloses only a single upper frame. In the prior art each tongue is supported for limited pivotal, rolling and pitching movement. It is also a feature of the above-referenced designs that the lower frame assembly is steerable with respect to the upper frame assembly. In the above-referenced designs, the load carrying structures are shiftable transversely, that is to say, from side to side perpendicular to the longitudinal centerline of the intermodal vehicle to facilitate the alignment of the trailer as it is connected to the intermodal vehicle. Additional features of the intermodal vehicle are disclosed in the foregoing patents. The prior art also discloses a novel transition vehicle which may be used to connect an intermodal vehicle to a conventional rail coupler.

The designs shown in the foregoing patent literature have validated the concept of making up a train with highway trailers supported on intermodal vehicles, each of the highway trailers being provided with leading and trailing coupler sockets, which sockets can be secured to an intermodal vehicle by a coupler pin which extends through aligned apertures in the sockets, and through an aperture in a coupler tongue carried by the intermodal vehicle. However, these designs have been complex and a more simplified design is desired which obtains the basic benefits of the prior art.

OBJECTS AND SUMMARY OF THE INVENTION

It is an object of the present invention to provide a refined intermodal vehicle wherein the upper load supporting frame is a unitary welded assembly which is supported a pair of lower steerable lower frame assemblies, there being coupler tongues in the form of a single double ended drawbar carried by the upper frame assembly in fixed relationship to front and rear load carrying surfaces on the upper frame assembly, the drawbar having front and rear vertically extending apertures which received vertically movable coupler pins for securing the intermodal vehicle to front and rear highway trailers.

In the prior art designs referred to above special forms of air spring assemblies were required. However, such air springs are difficult to assemble and maintain. Therefore it is an object of this invention to use conventional air spring assemblies which overcome the inherent disadvantages of the prior art air springs of special design.

In U.S. Pat. No. 5,890,433 a steering mechanism is shown (at 72 in FIG. 5). In addition, steering dampers are provided (at 96 in FIG. 3) to restrain horizontal movement of the upper frame assembly relative to the lower frame assembly. In U.S. Pat. No. 6,050,197 the steering means is shown at 61 in FIG. 4D. In addition, steering dampers are connected with the top of each associated single convolution air spring. It is an object of the present invention to provide an improved steering mechanism which does not require separate dampers. Thus, a novel steering mechanism is provided which consists of vertically extending cylindrical guide rods, each of which is received in apertured plates, each of the plates being mounted for spring resisted movement.

U.S. Pat. No. 6,050,197 teaches the desirability of a loading ramp. However, the loading ramp of the prior art design does not center the trailer onto the intermodal vehicle. Therefore, it is an object of the present invention to provide an improved loading and centering ramp. This design feature acts to both ramp the trailer up onto the intermodal vehicle and to shift it from side to side as it is being ramped up so that it is centered within a fraction of an inch over the coupler pin, the final centering being accomplished by a tapered coupler pin. This design eliminates the need for the load carrying surface to be transversely shiftable.

In the prior designs referred to above, while stop bars are provided, no mechanism is provided to cushion the stop bars. It is an object of the present invention to provide a stop bar mechanism which limits the relative motion of a highway trailer to the intermodal vehicle during train makeup, wherein the stop bar is provided with a cushioning mechanism.

It is a further object of the present invention to provide a new and novel mechanism for insuring that the upper frame assembly is maintained in its raised position even if there is a failure of air pressure. To this end a back up suspension system, in the form of coil springs, is provided. The coil springs are received in recesses in the upper frame assembly when the upper frame assembly is fully lowered relative to the lower frame assembly. However when the upper frame assembly is raised, the coil springs are prevented from entering into the recesses by shiftable plates in the form of paddles which cover the openings to the recesses. When the train of highway trailers is moving over the rails the coil springs serve to act as a backup suspension system. However, in the event of failure of the air springs, the coils springs will prevent the upper frame assembly from lowering when it is desired to maintain the upper frame assembly in a raised position.

It is a still further object of the present invention to provide an improved coupler pin and coupler pin operating mechanism which will permit the coupler pin to rock with the trailer when in its lifted coupling position, even though the drawbar may not be rocking.

It is yet another object of the present invention to provide a new and improved transition vehicle for coupling a train of highway trailers to conventional rail vehicles.

The foregoing design features will be better understood after a consideration of the following detailed description taken in conjunction with the accompanying drawings in which the best mode of practicing this invention is illustrated.

BRIEF DESCRIPTION OF THE DRAWINGS

FIG. 4 is a plan view of the leading and trailing lower frame assemblies and associated wheel assemblies.

FIG. 5 is as side view of FIG. 4.

IN GENERAL

Figure 1:
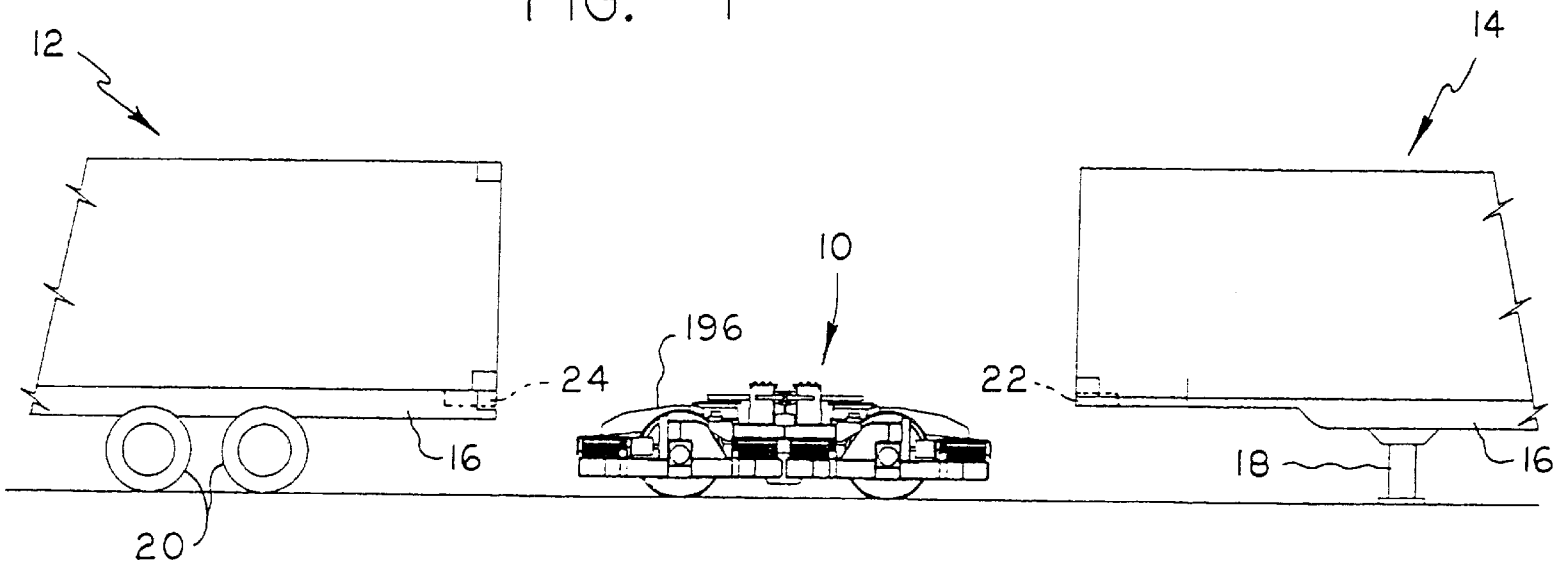
FIGS. 1 and 2 illustrate how a train can be made up using leading and trailing highway trailers and an intermodal rail vehicle, FIG. 1 showing the trailers and a prior design of an intermodal vehicle before makeup, with the intermodal vehicle being shown in the down position, and FIG. 2 showing the intermodal vehicle connected to the trailers with the intermodal vehicle in its raised position.
Figure 2:
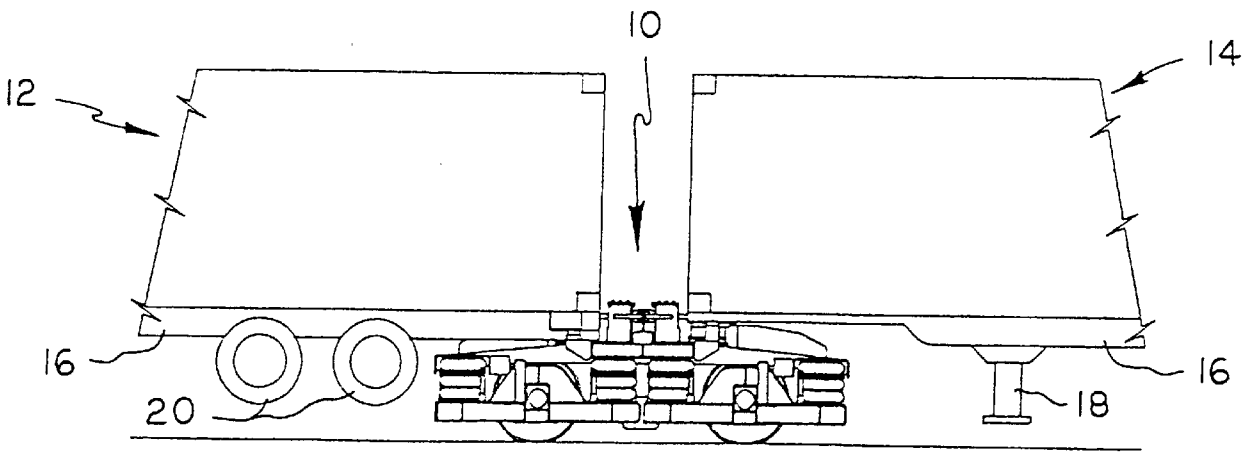
Figure 2A:
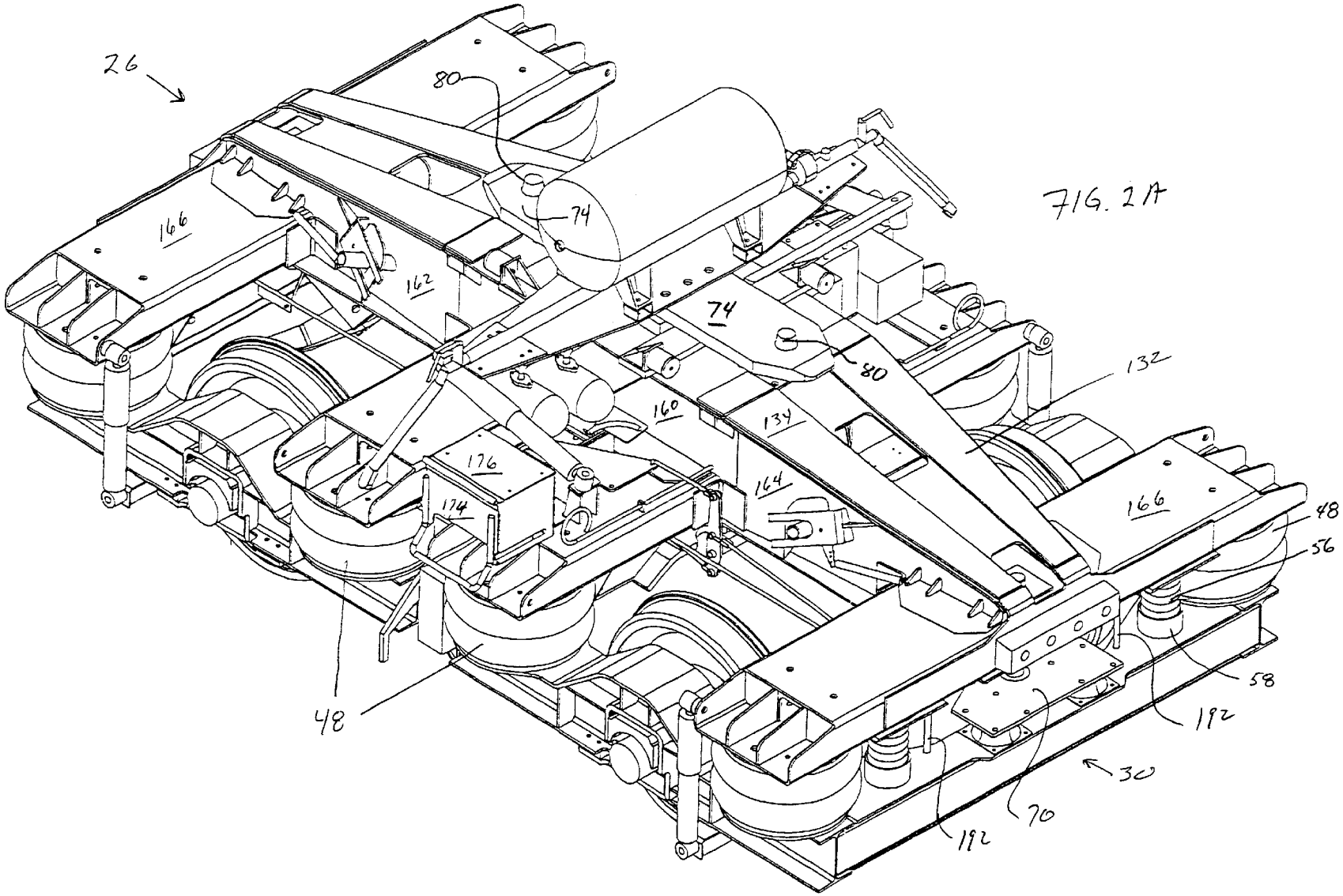
FIG. 2A is an isometric view of the intermodal vehicle of this invention.
Figure 2B:
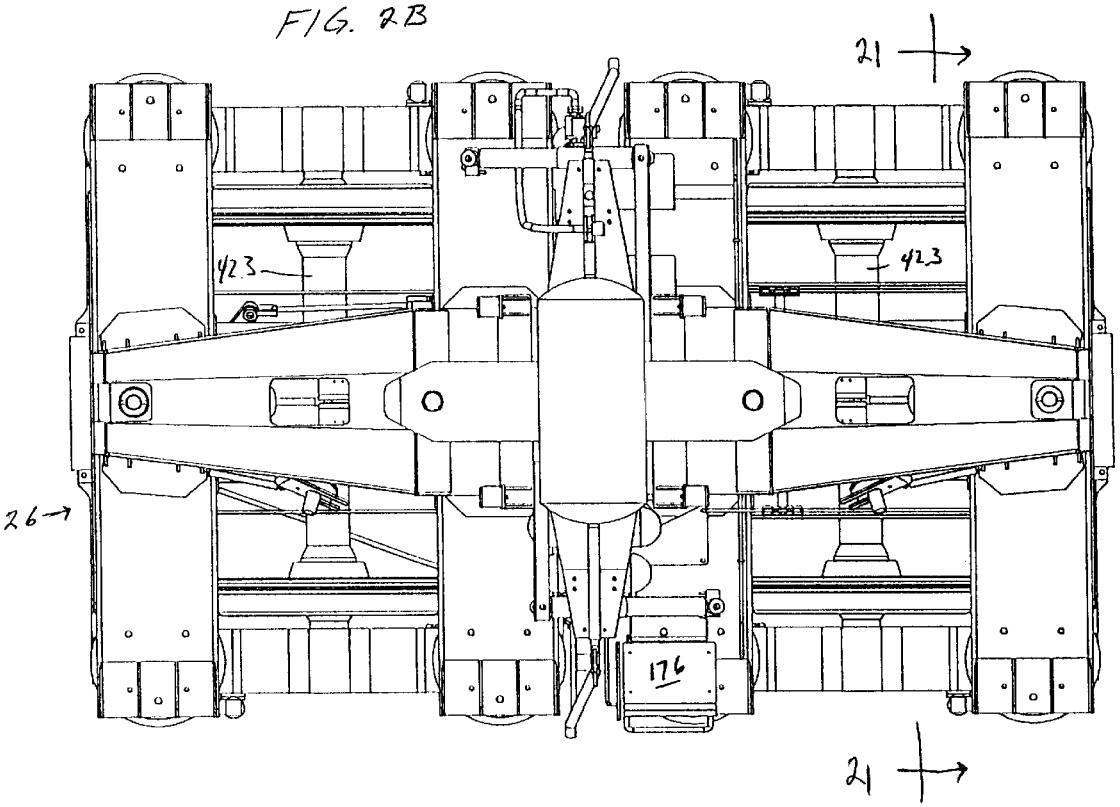
FIG. 2B is a top view of the intermodal vehicle shown in FIG. 2A.

In the following description right and left hand references are determined by standing to the rear of one of the trailers and facing its direction of travel. With reference initially to FIGS. 1 and 2, which show a prior design of an intermodal vehicle, the intermodal vehicle of this invention may be used in conjunction with other intermodal vehicles and highway trailers to form a train of highway trailers. The front end of the train is supported by a transition vehicle of this invention (shown in FIGS. 22–26) to couple it to a locomotive. It also may be supported at the rear end by the transition vehicle of this invention.

With reference now to FIGS. 1 and 2, the intermodal vehicles are indicated generally at 10, a leading highway trailer is indicated generally at 12, and a trailing highway trailer is indicated generally at 14. The highway trailers 12 and 14 are similar to the highway trailers shown in U.S. Pat. No. 5,890,433 but have been modified in three significant respects. Initially, it should be observed that all highway trailers for use with the intermodal vehicle of this invention are of the same configuration and the terms "leading" and "trailing" are only for the purpose of reference to the intermodal vehicle. Thus, the leading trailer 12 is identical to the trailing trailer 14. The modifications made to the trailers are in specific design changes to the coupler sockets at the front and the rear of the trailers, to the highway wheel suspension, and to the main frame to facilitate the loading of the leading trailer onto the intermodal vehicle. These changes will be discussed below.

Each of the highway trailers is provided with a main frame 16 which includes a pair of longitudinally extending spaced apart centrally located rails which may be used to guide the rear end of the leading trailer onto the intermodal vehicle of this invention. In addition, each of the trailers is provided with a forward landing gear 18, and highway wheel assemblies including wheels 20. The highway wheel assemblies are of an air suspension type, and are so designed that when the leading trailer is backed onto the intermodal vehicle when the intermodal vehicle is in its lowered position, the wheels will be lifted off the ground approximately 2.5 inches.

Figure 11:
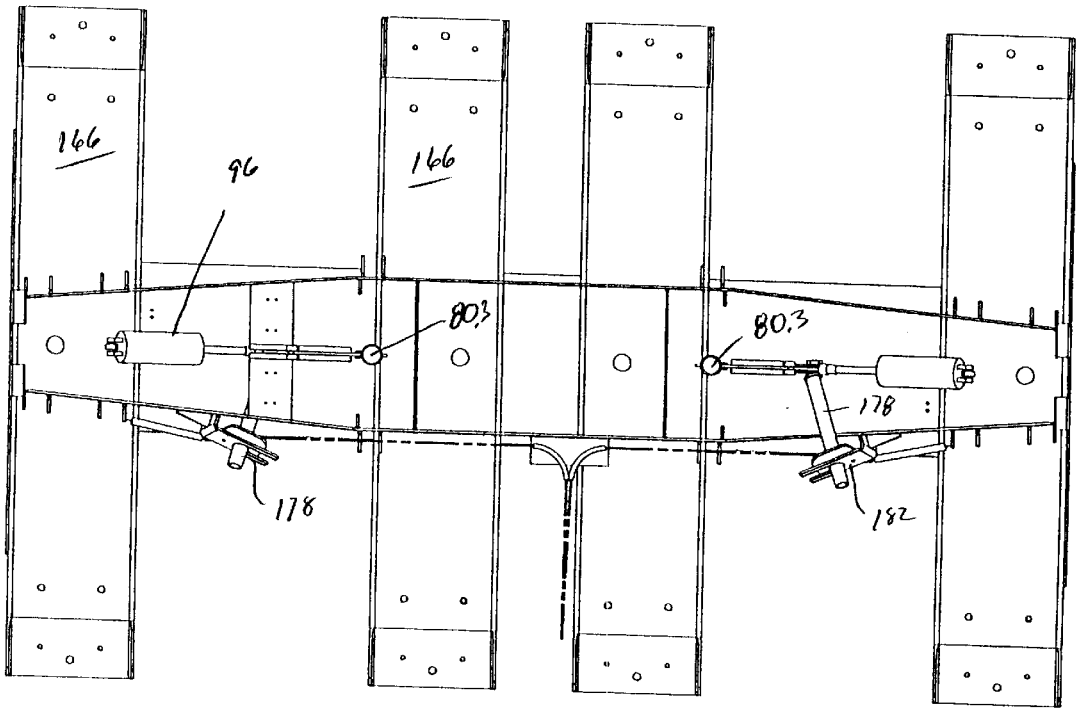
FIGS. 11 and 12 are top and side views, respectively, of upper frame assemblies to which the coupling pin assemblies and the mounting for the coupling pin assemblies are shown, the coupling pin assemblies being shown in their raised position in FIG. 12.
Figure 12:
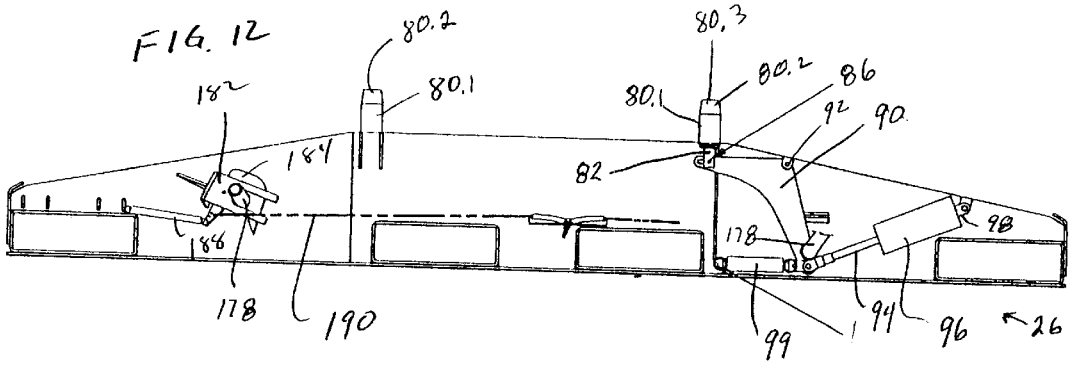
Figure 14:
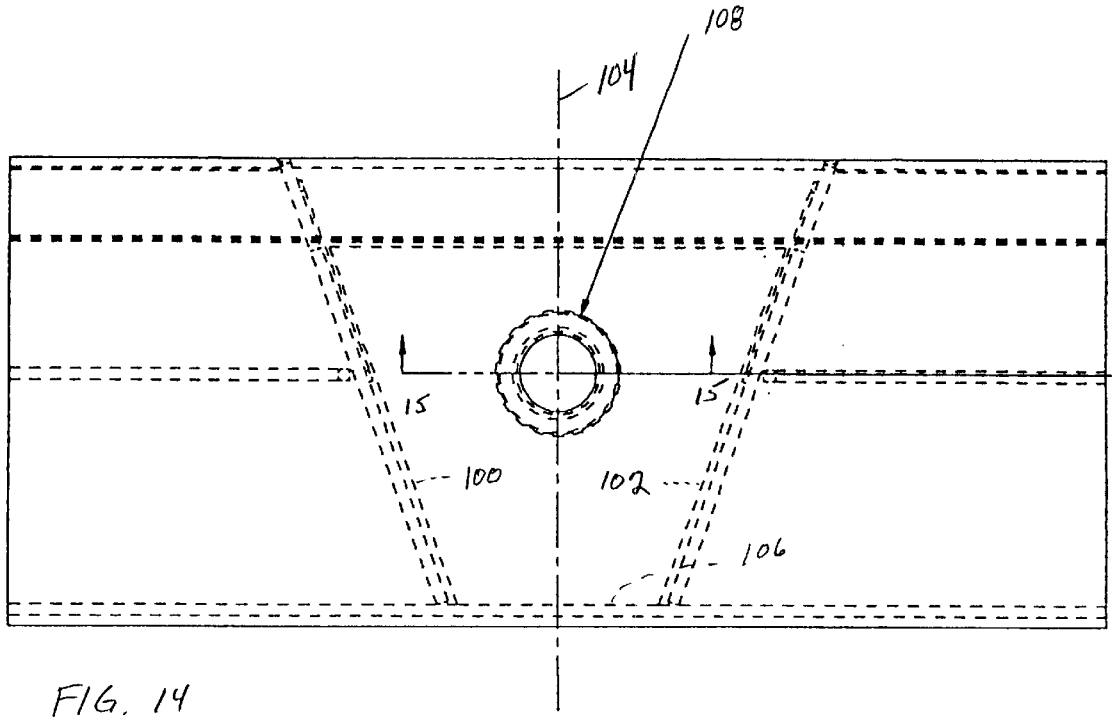
FIG. 14 is a plan view of a coupler socket assembly.
Figure 15:
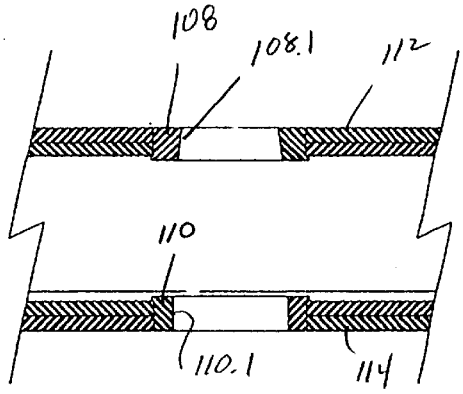
FIG. 15 is a sectional view taken generally along the line A—A in FIG. 14.
Figure 16:
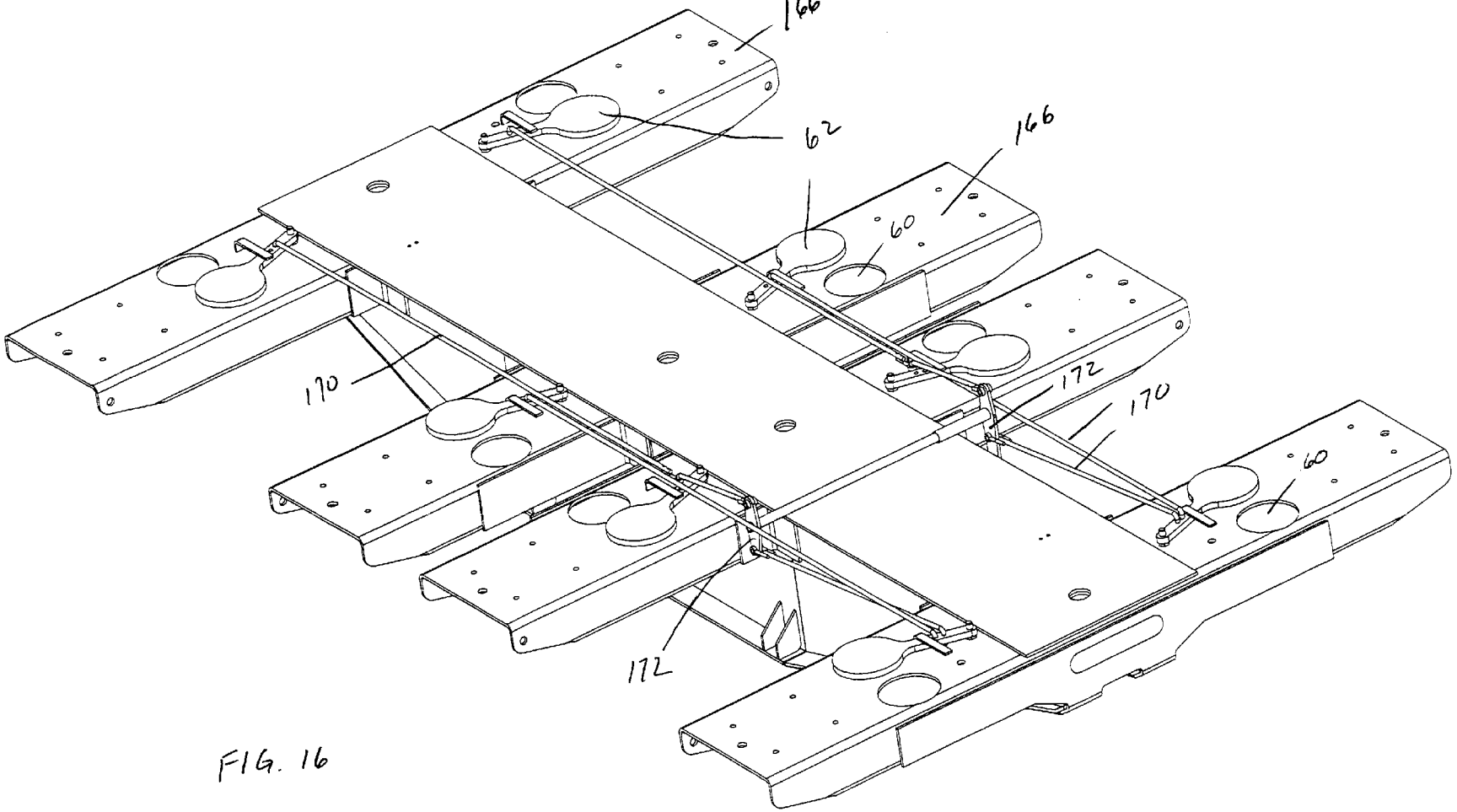
FIGS. 16 and 17 are bottom views of the upper frame assembly shown in FIG. 7, these views also showing paddles which uncover pockets, the upper end of auxiliary coil springs being received within the pockets when the upper frame is in its lowered position, but which paddles can be moved to a pocket covering position as shown in FIG. 17.
Figure 17:
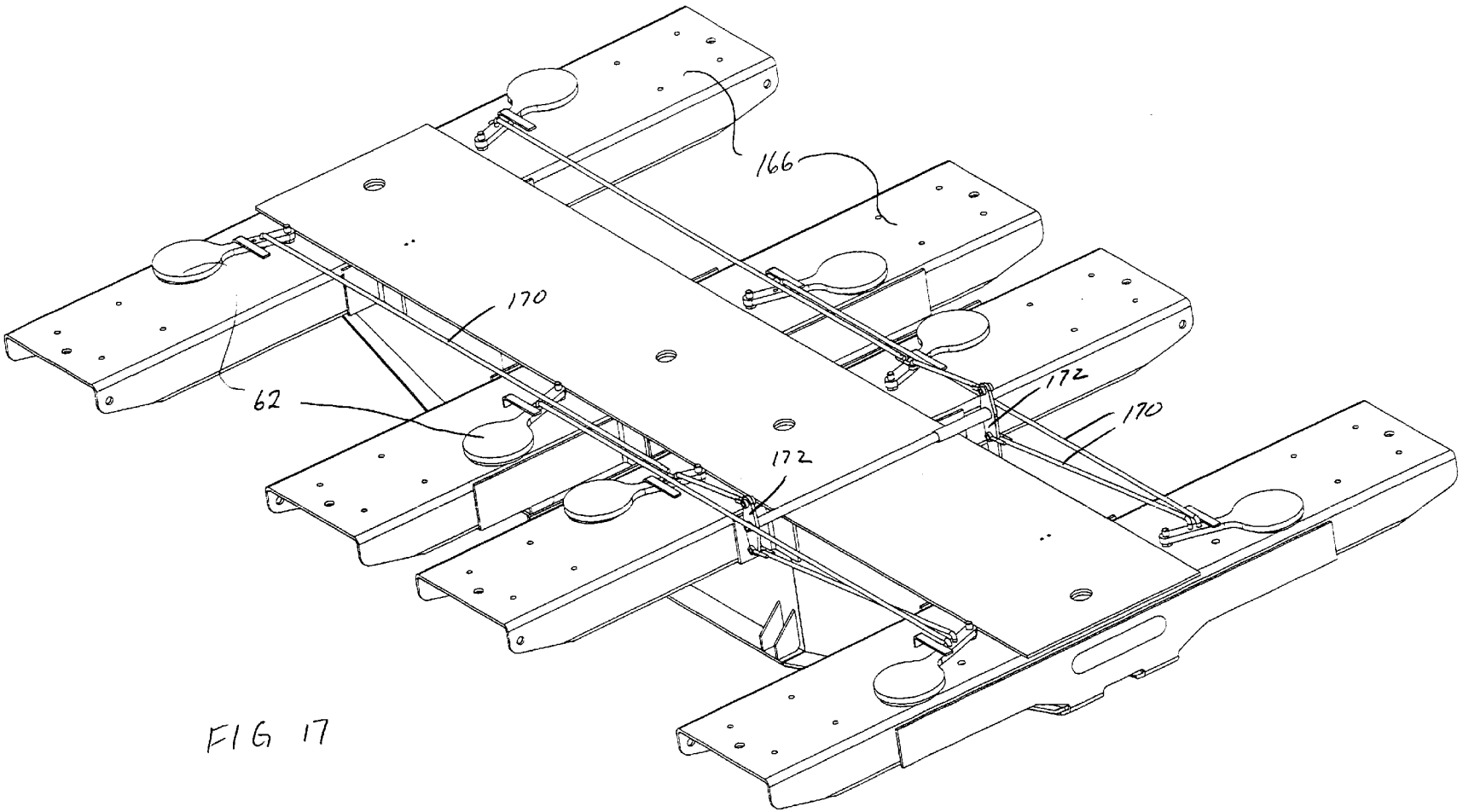
Figure 18:
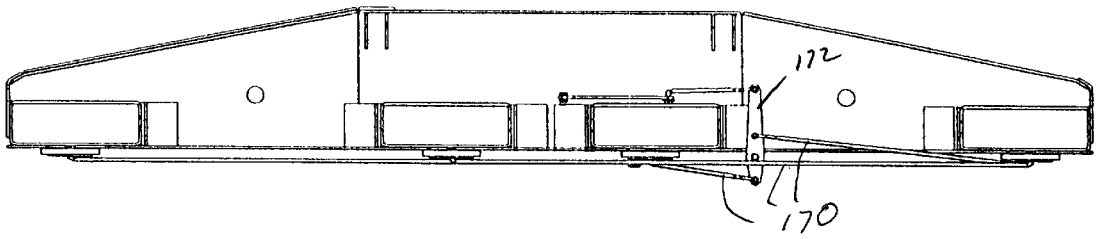
FIGS. 18 and 19 show the linkage for moving the paddles between their open and closed positions.
Figure 19:
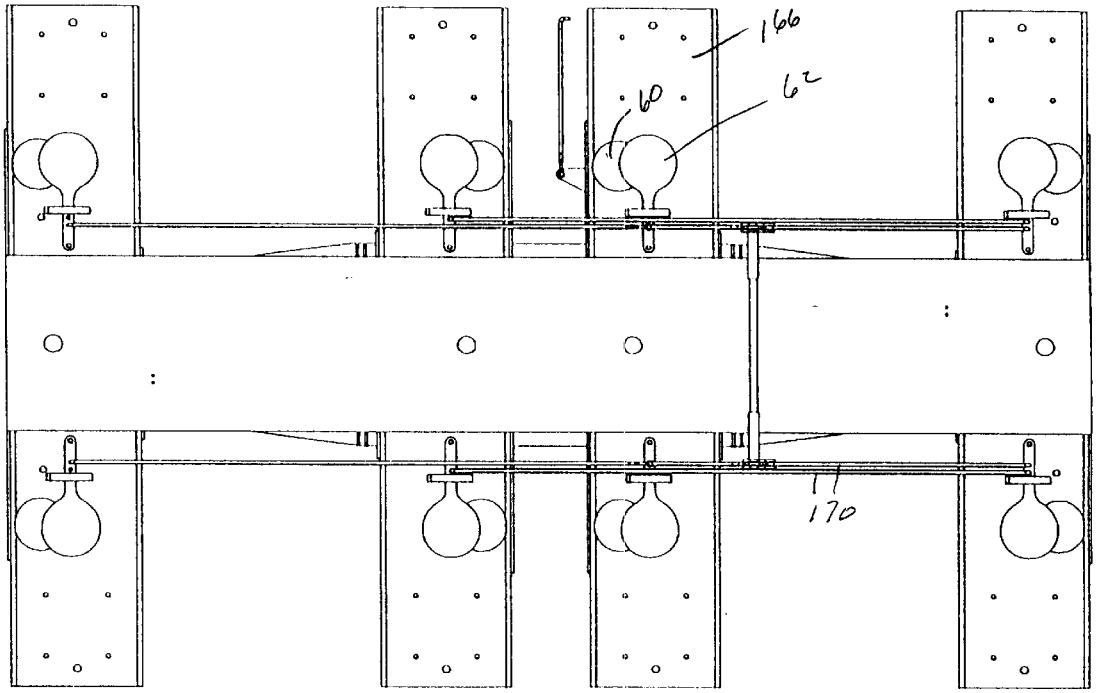
Figure 20:
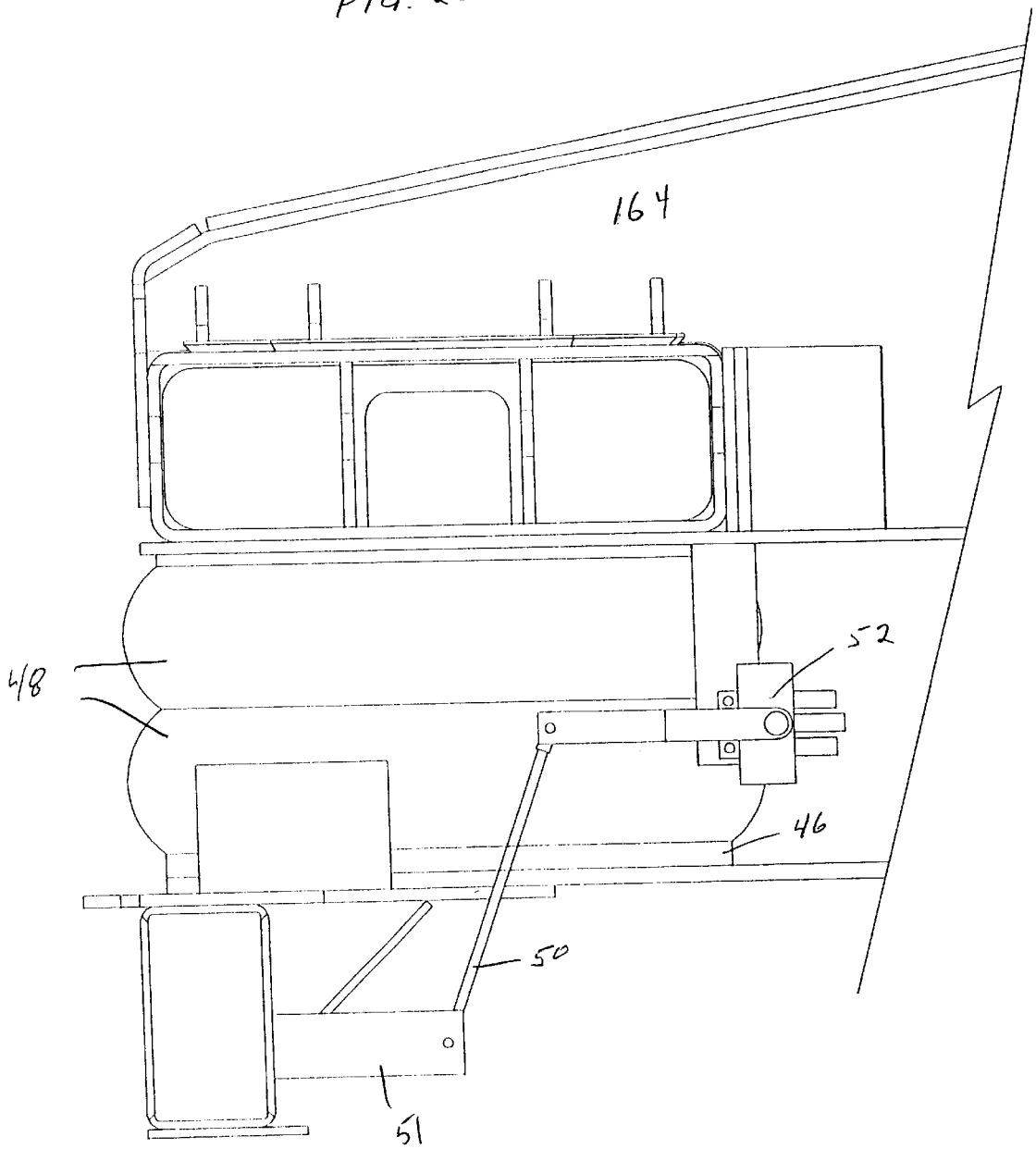
FIG. 20 shows an automatic air spring control valve for maintaining the air springs in their desired inflated ride position, this view being taken generally along the line 20—20 in FIG. 2D.
Figure 21:
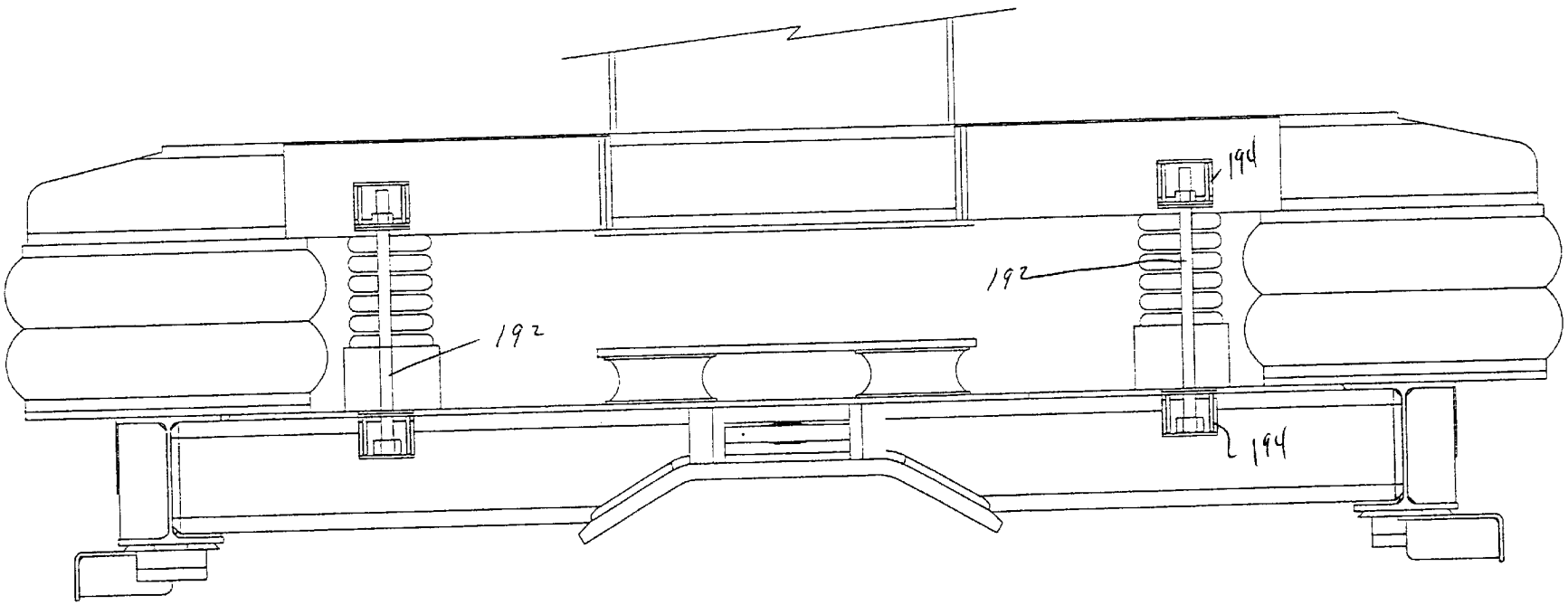
FIG. 21 shows the stops or over-extension rods for limiting the movement of the upper frame away from the lower frame, this view being taken generally along the line 21—21 in FIG. 2B.
Figure 22:
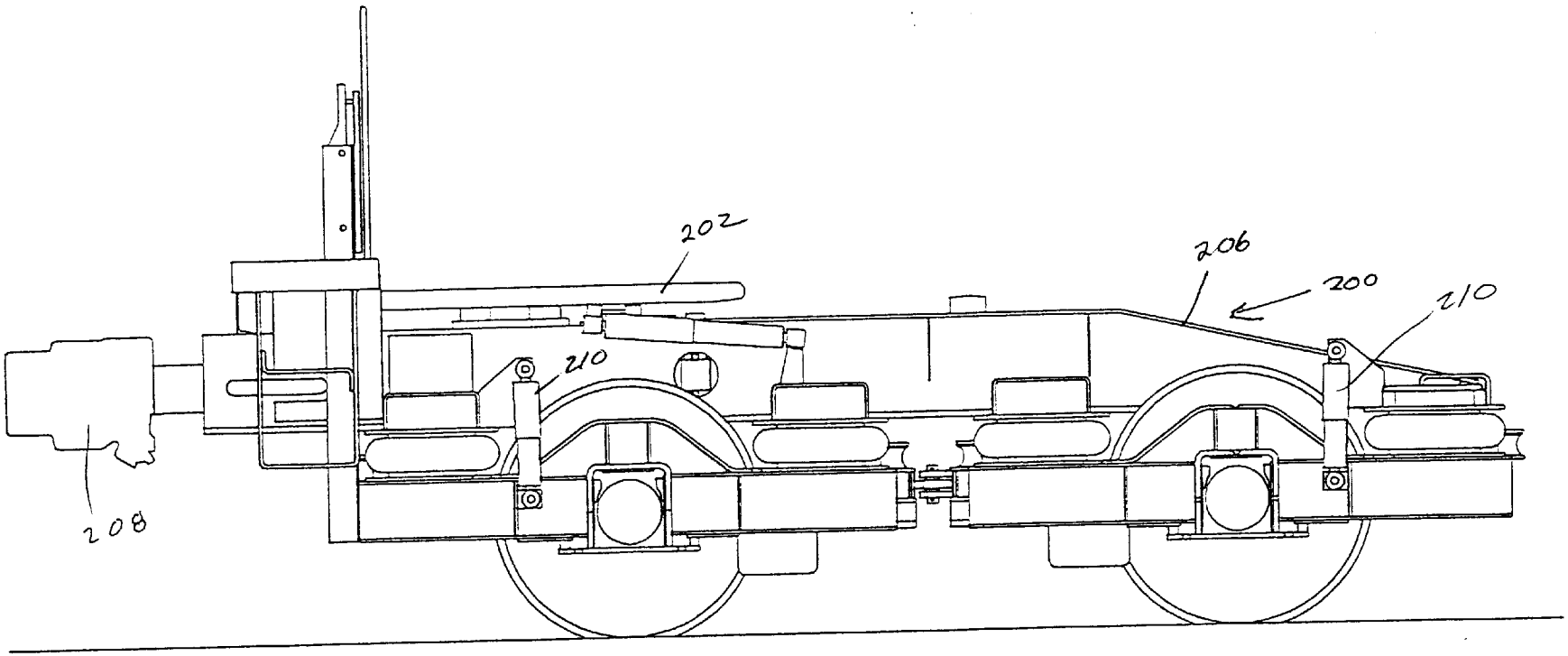
FIG. 22 is a side view of the transition vehicle which may be used to couple a train of highway trailers supported on the intermodal vehicles of this invention to an engine.
Figure 23:
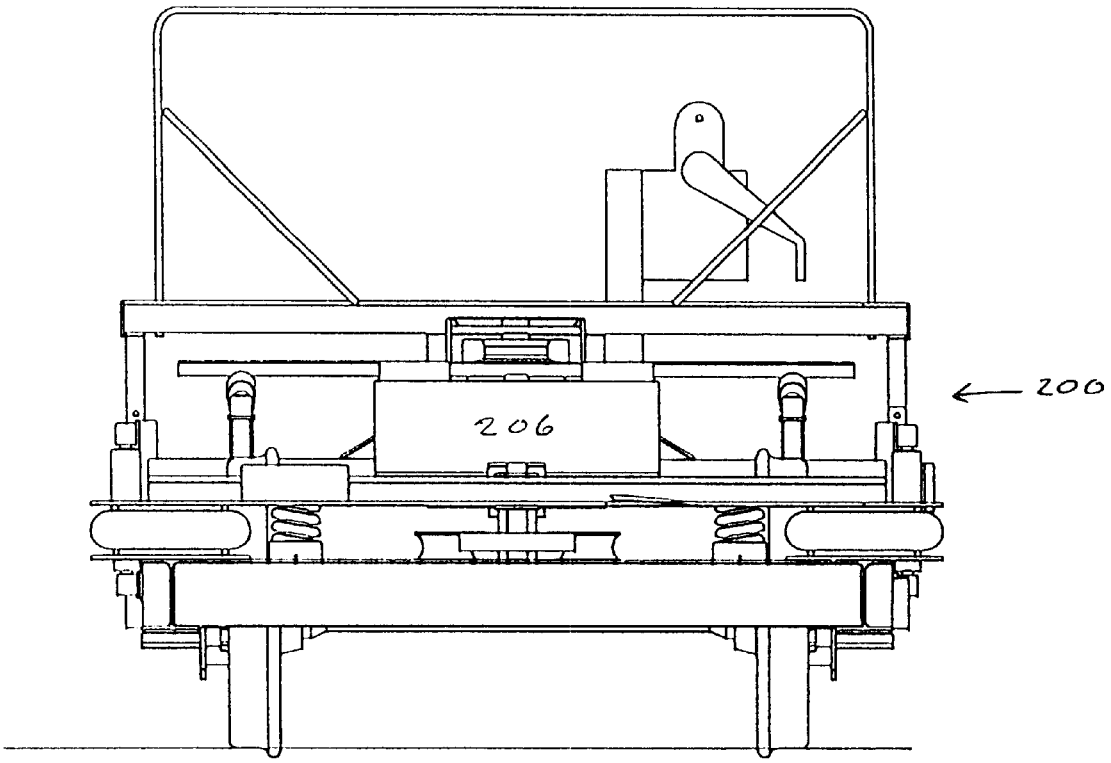
FIG. 23 is an end view of the intermodal vehicle shown in FIG. 22.
Figure 24:
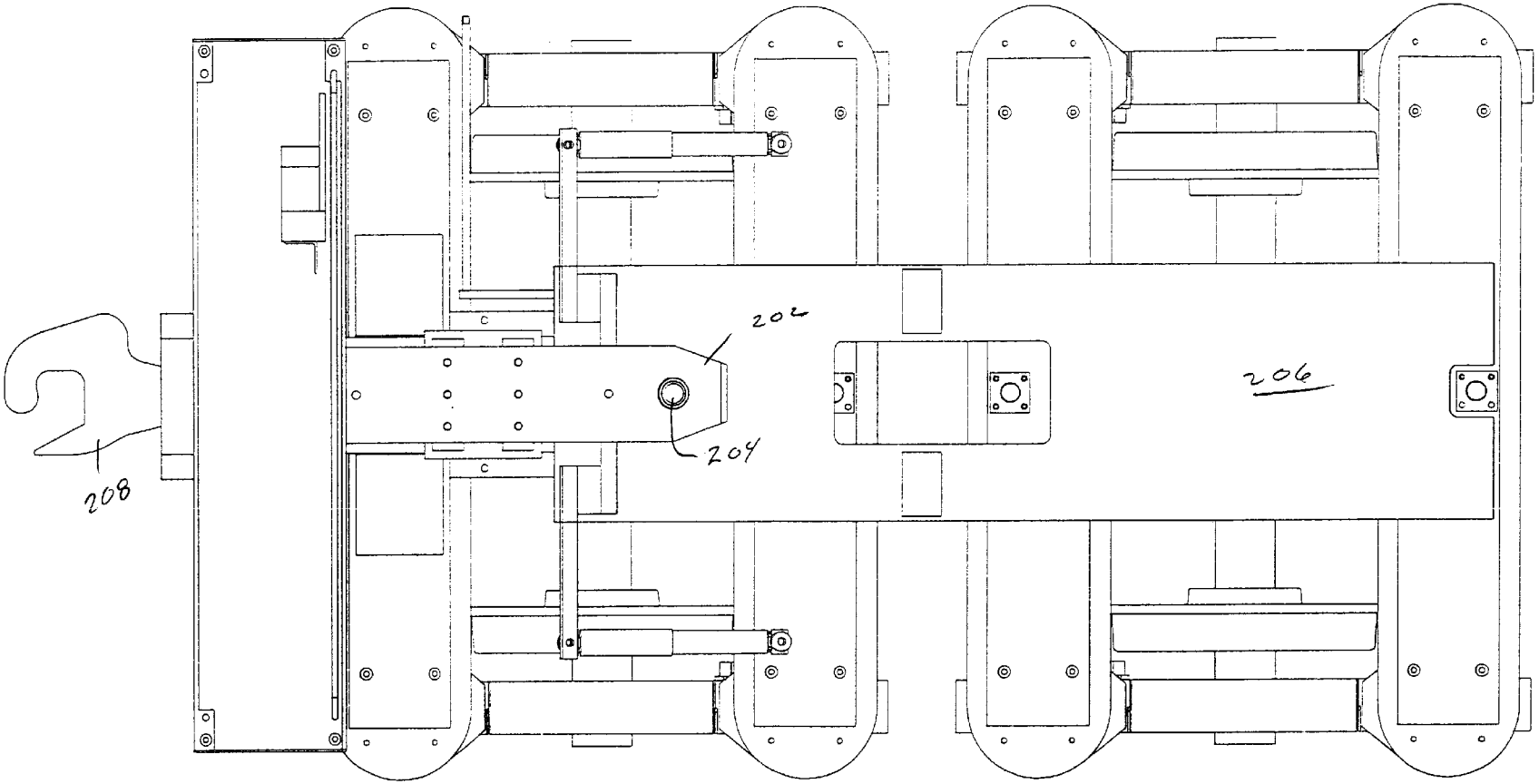
FIG. 24 is a plan view of the intermodal vehicle shown in FIG. 22.
Figure 25:
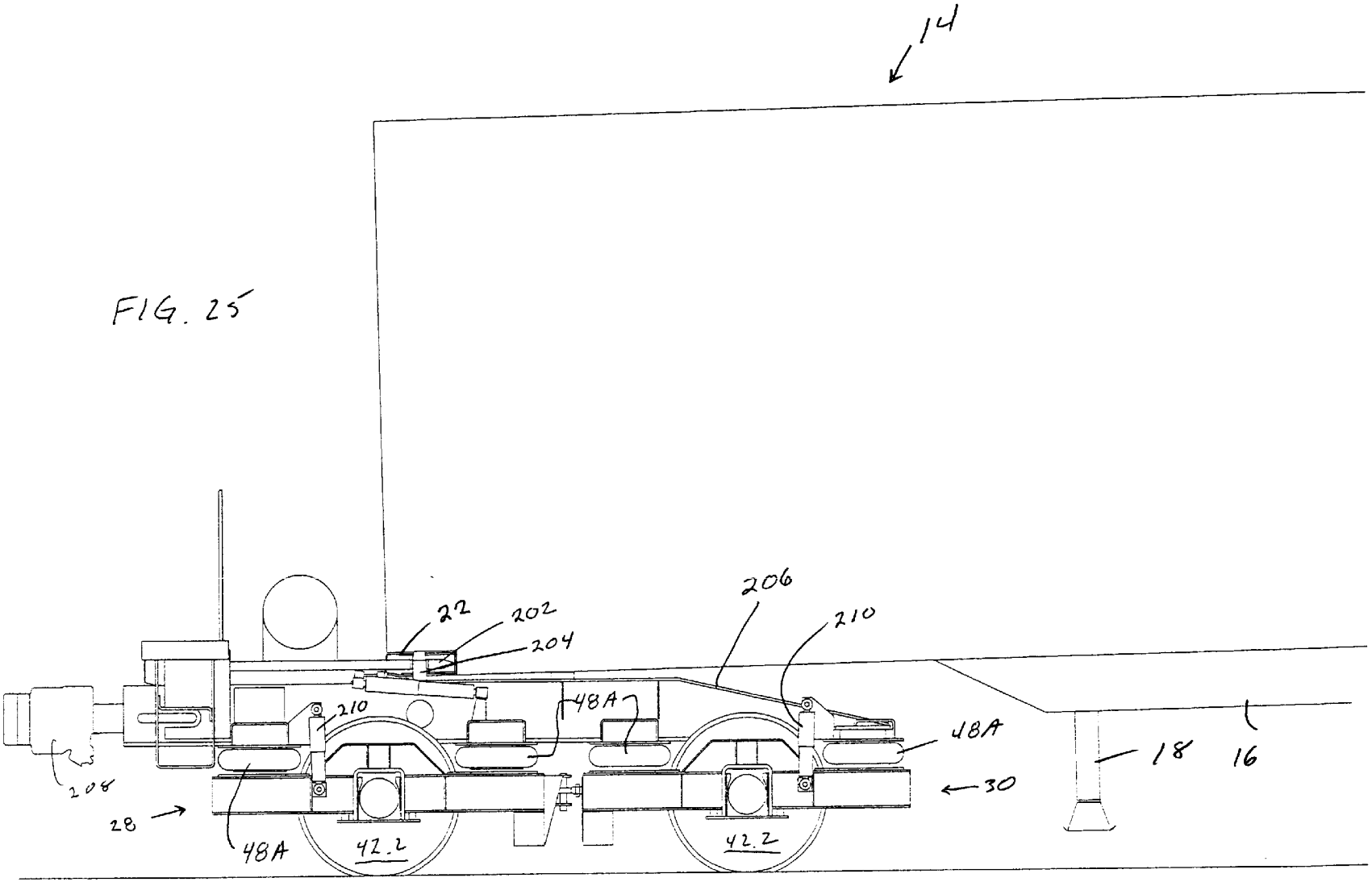
FIG. 25 shows how a highway trailer may be received on the intermodal vehicle shown in FIG. 22.

As previously noted, each highway trailer is provided with leading and trailing substantially identical coupler socket assemblies 22 and 24, respectively. Details of the newly designed coupler sockets are shown in FIGS. 14 and 15 and will be described later. In any event, each coupler socket may receive one end of a coupler tongue or draw bar, which is best illustrated in FIGS. 7A and 7B, and each socket assembly is further provided with vertically spaced apart aligned apertures to facilitate securing one end of a draw bar within the socket assembly via a coupler pin carried by the intermodal vehicle. The coupler pin is best shown in FIG. 12 and the operating mechanism for operating the coupler pin is illustrated in FIGS. 11 and 12.

THE INTERMODAL VEHICLE

Figure 3:
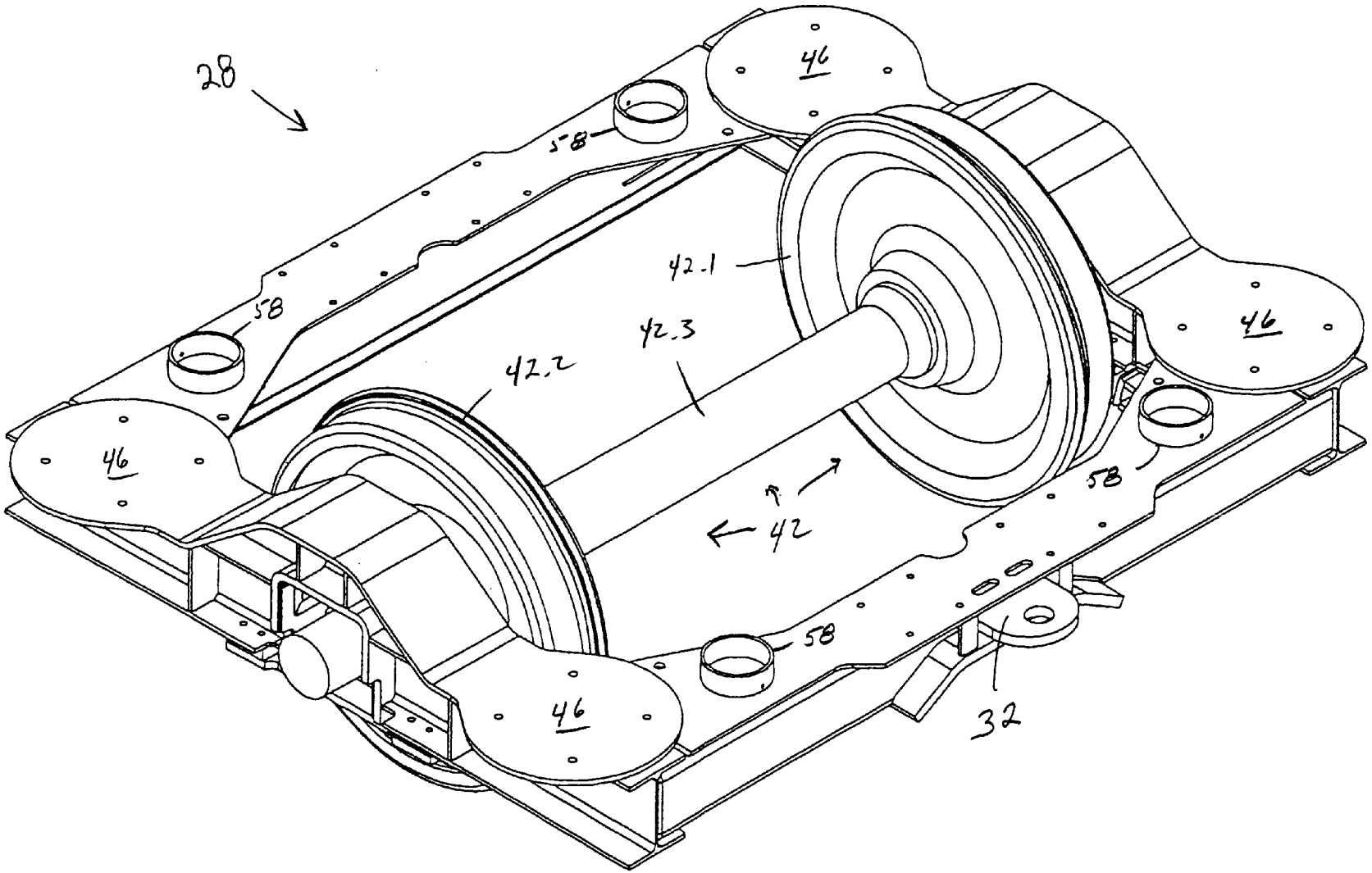
FIG. 3 is an isometric view of the leading lower frame assembly.
Figure 5A:
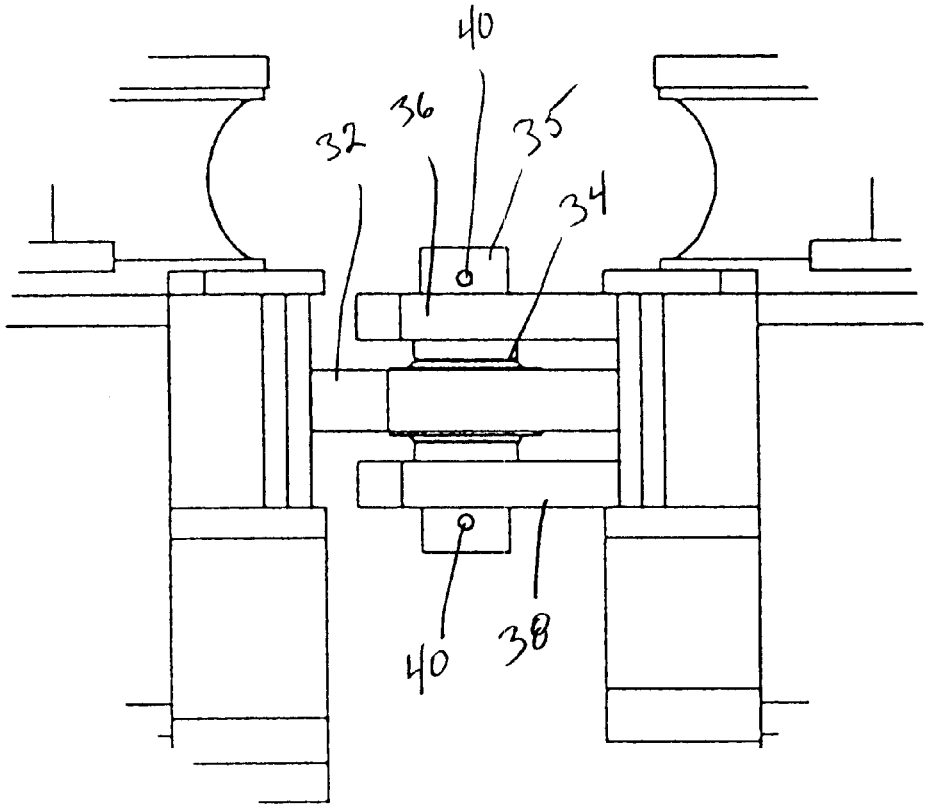
FIG. 5A is an enlarged detail of FIG. 5.
Figure 6:
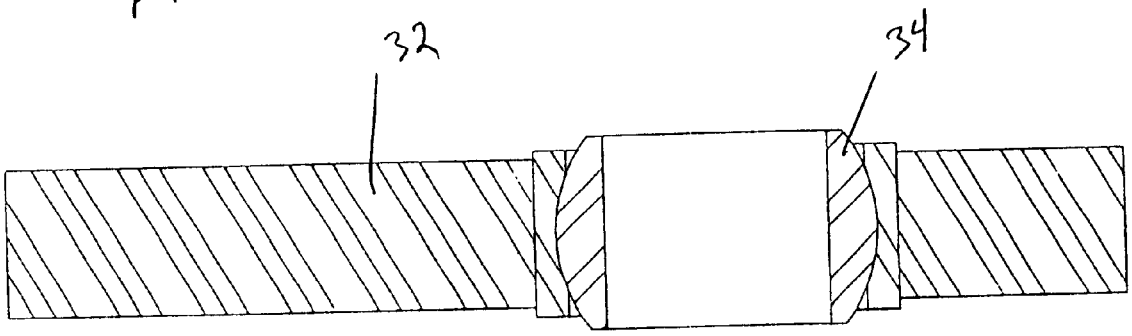
FIG. 6 is an enlarged sectional view of the leading lower frame assembly drawbar.
Figure 7:
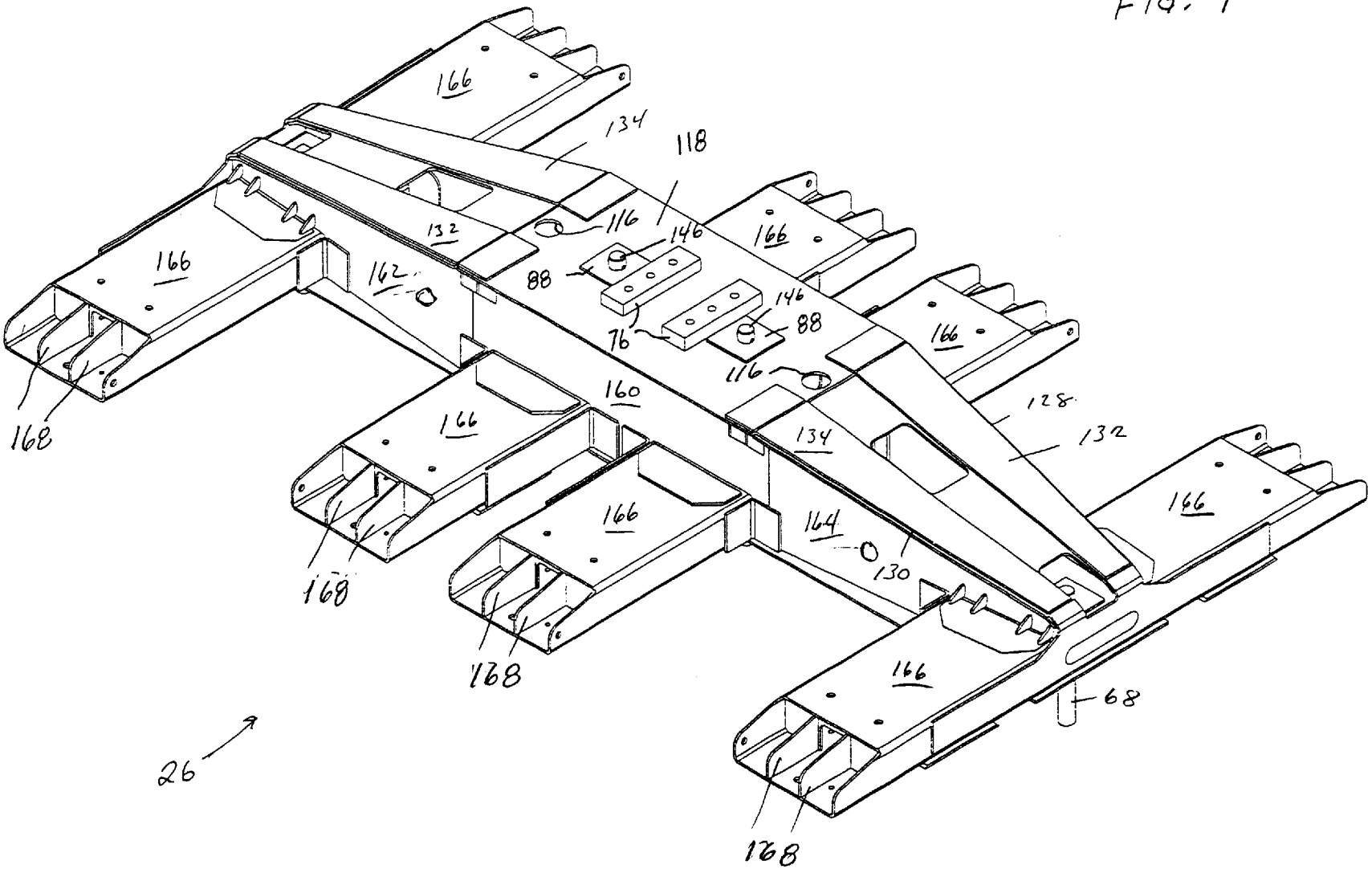
FIG. 7 is an isometric view of the upper frame assembly.
Figure 7A:
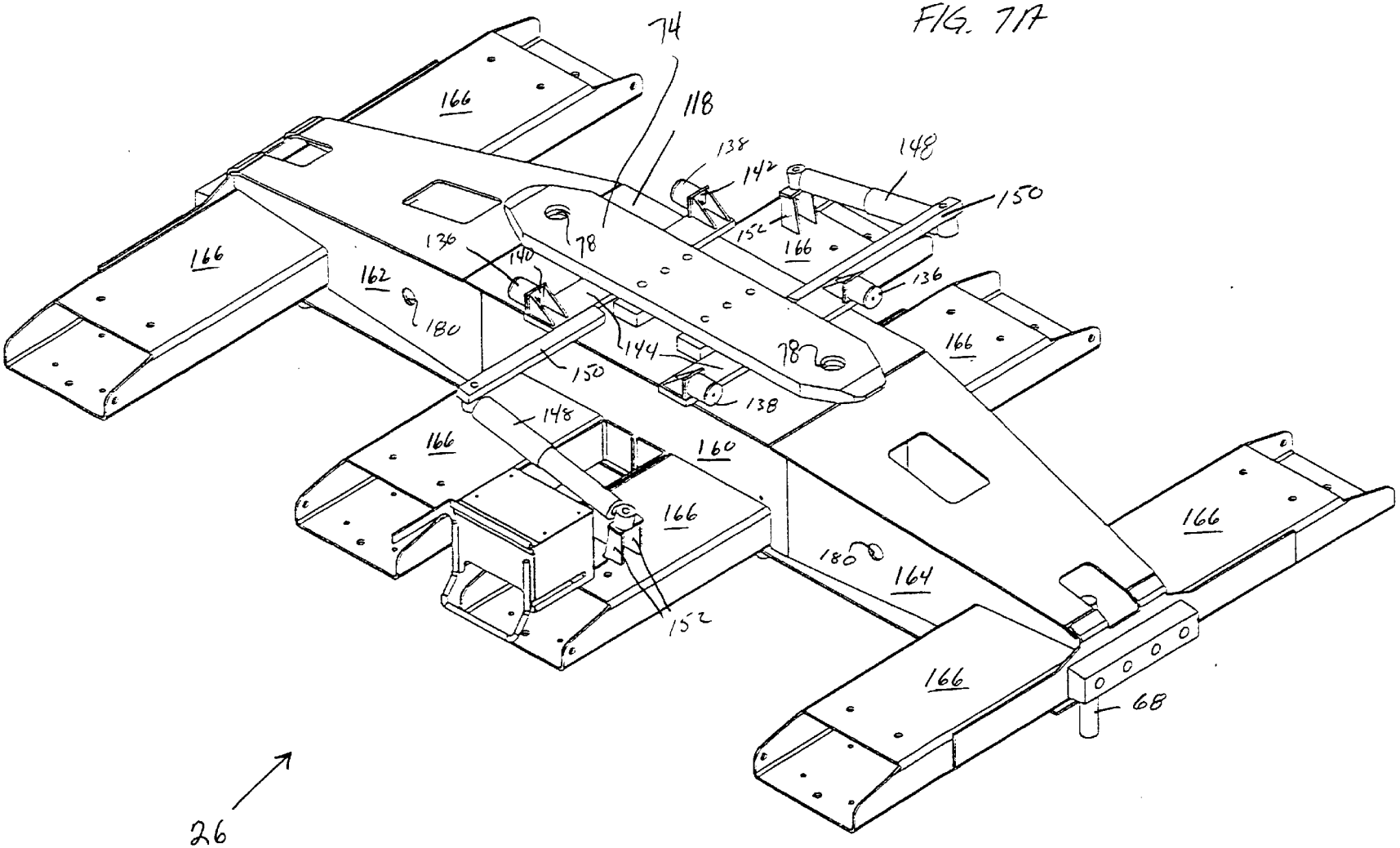
FIG. 7A is a view similar to FIG. 7 but with some parts of the upper frame weldment being omitted, and other parts, including a continuous drawbar and trailer stop assemblies, being shown mounted thereon.
Figure 7B:
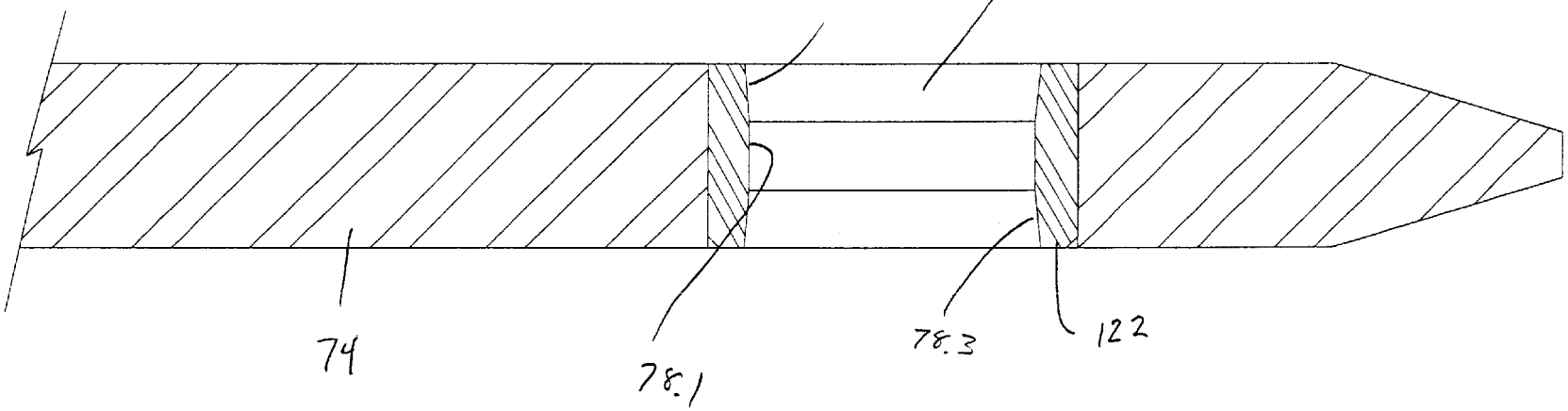
FIG. 7B is a section through a portion of the drawbar shown in FIG. 7A.
Figure 9:
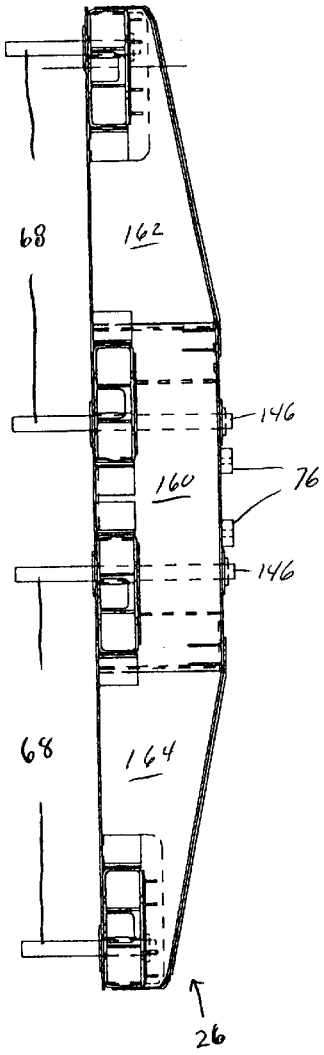
FIGS. 8, 9, and 10 are plan, side, and end views, respectively, of the upper frame assembly.
Figure 8:
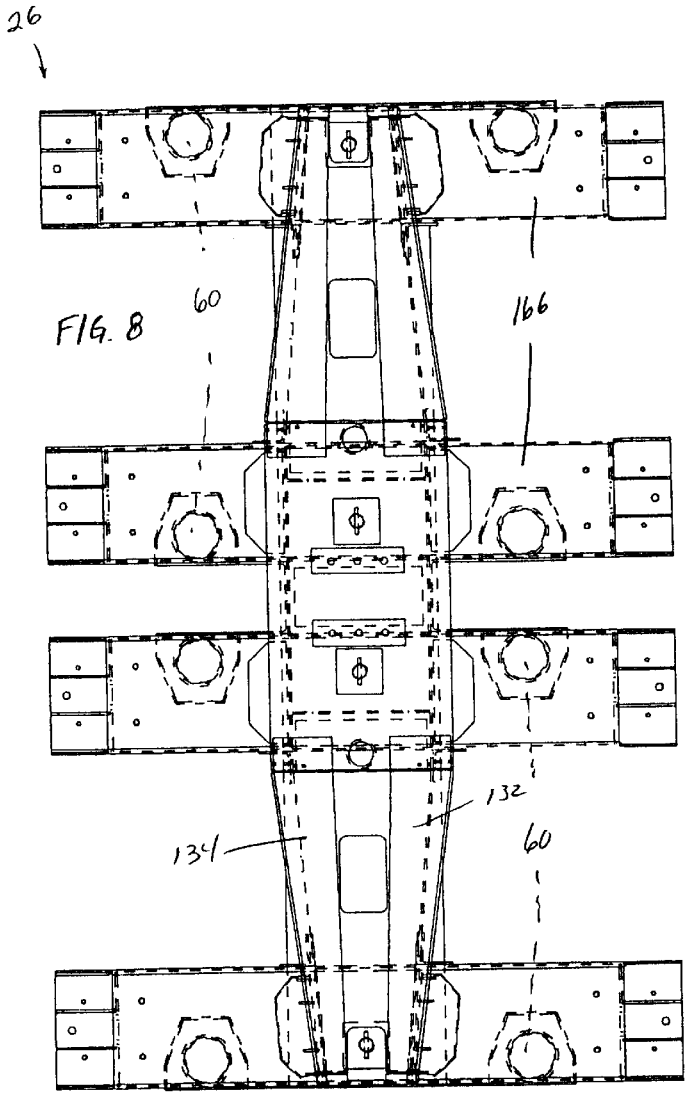
Figure 10:
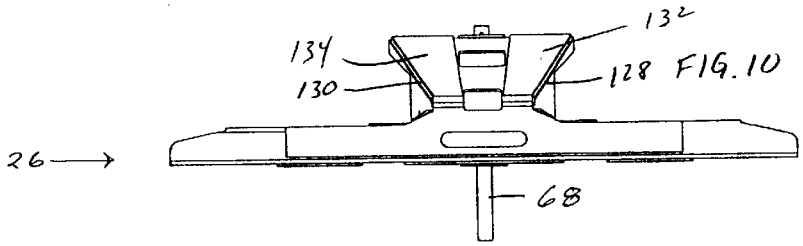

With reference now to FIGS. 2A–21, the intermodal vehicle of this invention consists of an upper frame weldment indicated generally at 26 in FIG. 7, a leading lower frame weldment indicated generally at 28 in FIGS. 3–5, and a trailing lower frame weldment indicated generally at 30 in FIGS. 4 and 5. These two lower frame weldments are essentially identical except for the structure which is used to couple one of the lower frame weldments to the other. Thus, the leading lower frame weldment is provided with a single draw bar plate 32 which receives a spherical bushing 34. The central portion of bushing 34 is so designed that it will snugly receive the coupling pin 35 shown in FIG. 5A. The trailing lower frame weldment differs from the leading lower frame weldment in that it has upper and lower spaced apart draw bar plates 36, 38 which are provided with vertically aligned apertures which can snugly receive the coupling pin 35 while still permitting rotation about the vertical center line of the coupling pin. When the leading and trailing lower frame weldments are assembled to each other, the coupling pin is inserted within the aligned apertures in drawbar plates 36, 38 and bushing 34, the coupling pin being held in place by removable pins 40.

Each of the leading and trailing lower frame assemblies receives a rail wheel assembly 42, all rail wheel assemblies being identical, and each of the rail wheel assemblies having spaced apart rail wheels 42.1, 42.2 carried by a live axle 42.3. The ends of the axle 42.3 are received within suitable bearing assemblies 44 of conventional design. The bearing assemblies are mounted within each of the lower frame weldments. It can be seen that the two lower frame weldments and wheel assemblies form a portion of a steerable rail truck. Thus, each of the leading and trailing lower frame weldments can pivot with respect to the other about the vertical center line of the coupling pin 35. In addition, they can also twist or rock as the bushing 34 permits such movement.

As best shown in FIGS. 7 and 7A, the upper frame weldment 26 includes a central box like section 160 which has an upper surface 118, and leading and trailing box extensions 162, 164, which taper downwardly from the top plate 118, and which also taper inwardly so that the end of each of the box extensions 162, 164, is lower and narrower than the top plate 118. The upper frame weldment also includes right and left hand box beam assemblies 166, there being eight in all, four to each side. As can be seen from a comparison of FIGS. 7 and 7A, the end of each box beam may support a pair of reinforcing brackets 170. Air bags 48 support the ends of each box beam assembly 166.

Figure 2C:
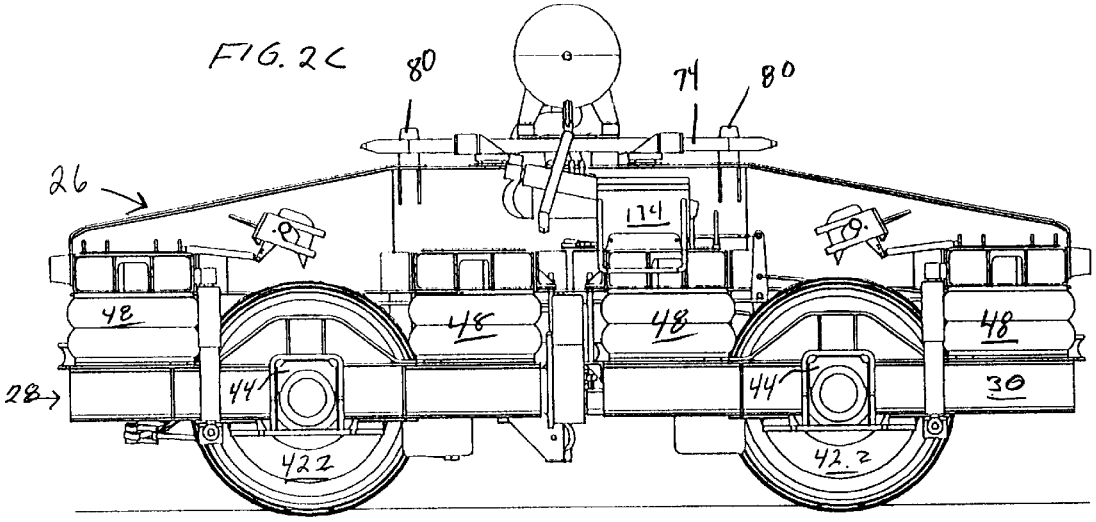
FIGS. 2C and 2D are side and end views of the intermodal vehicle shown in FIG. 2A, the vehicle being shown in its normal operation position.
Figure 2D:
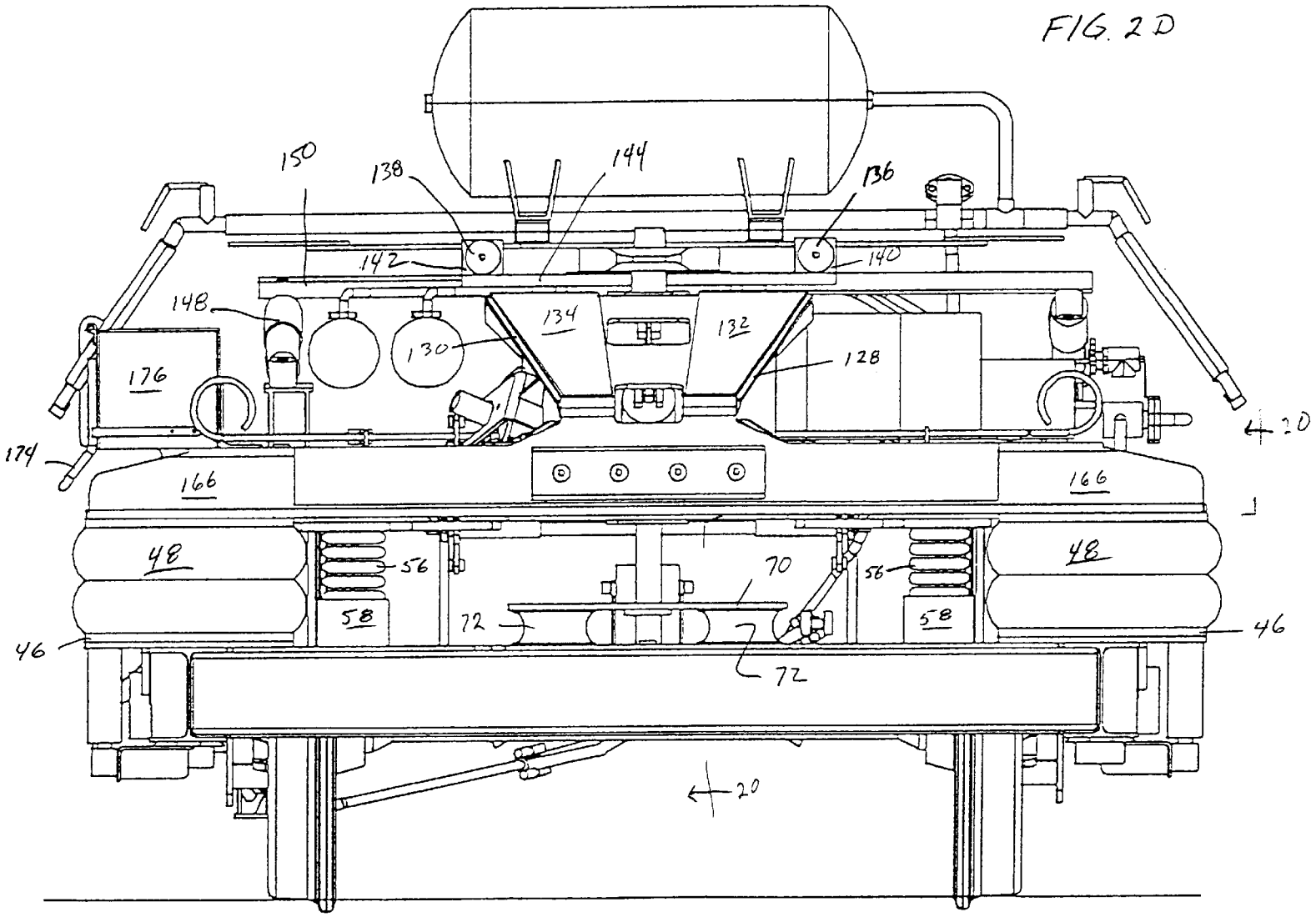

The upper frame weldment 26 is supported on the leading and trailing lower frame weldments for adjustable movement between a fully lowered position (FIG. 2F), a fully raised position (FIG. 2E), and cushioned intermediate operating positions (FIG.2C). To this end, each of the lower frame weldments is provided with two pair of air bag support plates 46, one pair being located before and after each of the rail wheels 42.1 or 42.2. The air bags are designed to have a vertical movement of 8" from their fully lowered position to their fully raised position, and are normally maintained at their desired ride height of 6½" by a suitable valve mechanism. To this end, a link 50 is interconnected with a suitable ride control valve 52 shown in FIG. 20. The link 50 is connected via a bracket 51 which is in turn supported on a transverse box beam of a lower frame assembly 28, 30, which beam is remote from the pivot pin 35. The valve 52 is supported by a bracket 53 carried by a box-like extension 162, 164. These valves may be similar to the valves 202.1 and 202.2 shown in U.S. Pat. No. 5,890,433. As the actual ride control mechanism forms no part of the present invention, it will not be described further.

There is a possibility that air may be lost from one or more of the air bags during the operation of the intermodal vehicle. In order to prevent a collapse of the upper frame onto the lower frame if there is such a loss of air, and also to maintain a spring suspension of the upper frame assembly upon the lower frame assemblies, coil spring assemblies are provided. There is one coil spring assembly for each of the air bags. Each of the coil spring assemblies consists of an outer coil spring and a nested inner spring (not illustrated). Each of the coil spring assemblies is received within a coil spring assembly receiving sleeve 58 which is welded to a portion of the associated lower frame weldment. If the coil springs were to bear directly against the bottom of the upper frame weldment, then it would not be possible to lower the upper frame. Therefore to this end the upper frame weldment is provided with spring receiving pockets 60 (FIG. 16), one for each of the box beams 166, which pockets may be covered by shiftable paddles 62 which are shown in their uncovering position in FIG. 16 and their pocket covering position in FIG.17. The paddles 62 may be moved from their pocket covering position to their uncovering position by a suitable operating mechanism.

The operating mechanism includes various links 170 and levers 172 which are interconnected in suitable manner to a pivotal lid or cover plate 174 of a control box assembly 176. The control box contains air control valves for operating the air bags 48, and also the air control valves for the coupler pins which are used to couple the leading and trailing trailers to the drawbar. Assuming the upper frame is in its raised position, in order to lower the upper frame, the control box lid is raised which will cause the paddles to move from their FIG. 17 position to their FIG. 16 position. Air can now be vented out of the bags lowering the upper frame to the lower position shown in FIG. 2F.

While the leading and trailing lower frame weldments are steerable, it is desirable to provide a mechanism which will urge the steerable lower frame weldments back to a position where their fore-and-aft horizontal centerline is parallel to the fore-and-aft horizontal centerline of the upper frame weldment. To this end, the upper frame is provided with four vertically extending guide rods 68, which guide rods are located on the centerline of the upper frame weldment. Each of the guide rods 68 extends downwardly from the upper frame, and is received by an apertured associated plate 70, FIGS. 2A, 2D and 4. Each apertured plate is mounted on a pair of rubber or rubberlike shear spring 72 which are in turn secured to the lower frame.

A continuous drawbar 74 is bolted to transverse mounting bars 76 which are part of the upper frame weldment. Each end of the drawbar 74 is provided with a bushing 122 having an aperture 78. A pair of coupling pins 80 is carried by each intermodal vehicle 10. Each coupling pin 80 has a cylindrical portion 80.1, and a frusto-conical upper portion 80.2 (FIG. 12). Each coupling pin is secured to a mounting bracket 82, the mounting bracket having a pair of spaced apart apertured ears. Each of the coupling pins is adapted to cooperate with one end of the drawbar 74 to couple the associated end of the drawbar to a coupler socket 22 or 24 in a trailer. The coupler pin can be moved from a lower position (not shown) to an upper position best shown in FIG. 12. In the lower position, the upper surface 80.3 of the coupling pin is approximately in line, or just slightly below the upper surface of the wear pads 88 (FIG. 7) on the upper frame weldment. In order to move each coupler pin, each coupler pin is interconnected to a bell crank 90 by a pivot pin 86. The bell crank is pivotally mounted on pivot pin 92 which is suitably secured within the upper frame weldment 26 in a manner not material to the present invention. The bell crank is caused to be operated by piston rod 94 of an air cylinder 96. The anchor end 98 of the air cylinder is suitably pivotally secured within the upper frame weldment 26. The air cylinder 96 is caused to be operated in any suitable manner to move the coupled pin from its lowermost position to its uppermost position shown in FIG. 12. A coil spring 99 is provided to return the coupler spring 80 to its raised position in the event of loss of air pressure to cylinder 96.

Figure 13:
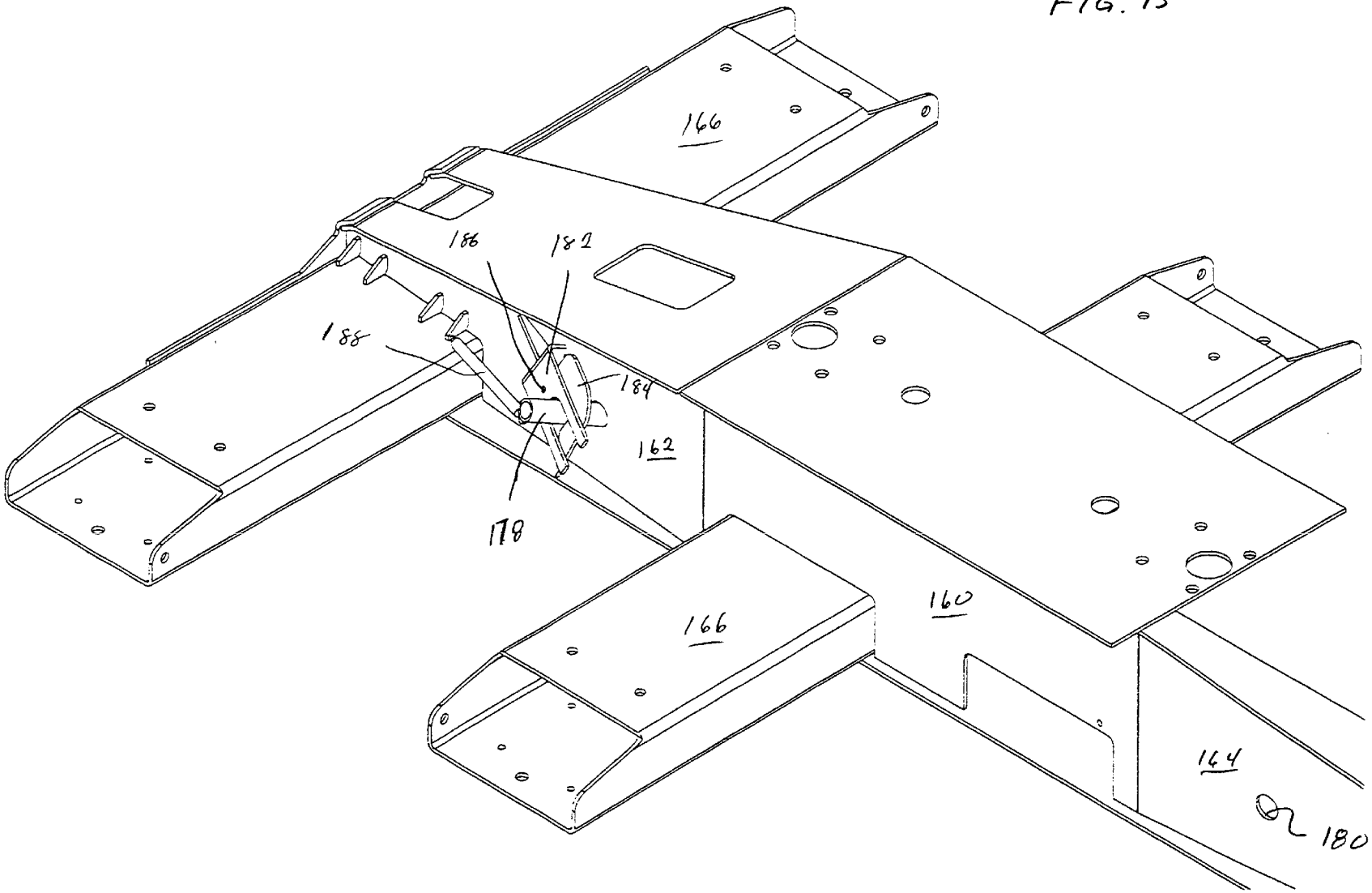
FIG. 13 is a partial isometric view similar to FIG. 7A but further showing a locking mechanism.

A manual pin lock mechanism is provided, which mechanism is best shown in FIGS. 11 and 13. This mechanism includes of a pair of tubular members 178, one in each of the box beam extensions 162, 164. Each tubular member has a first end secured to the lower end of bell crank 90, an intermediate portion which passes through an aperture 180 (FIG. 7A) in a side wall of the associated box beam extension, and a second end which passes through a suitable slot in a an L-shaped bracket 182 which is suitably welded to the side of the box beam 162 or 164. A latch 184 is pivotally secured to the bracket 182 by pivot pin 186. The latch is normally held in its latching position by spring 188, which latching position is the coupler pin up position shown in FIG. 12. However, the latch may be opened by a cable 190 which has one end secured to the pivoted lid 174 when it is desired to lower the coupler pins 80. When the pivoted lid 174 is down in the position shown in FIG. 2A, the latch 184 will be in the position shown in FIGS. 11–13. However, when the lid 174 is up, the cables 190 will cause the latches 184 to pivot, extending springs 188, and which will permit the tubular member 178 to pivot about the aperture 180 when the piston rod 94 is retracted to lower the coupler pin 80.

Figure 2E:
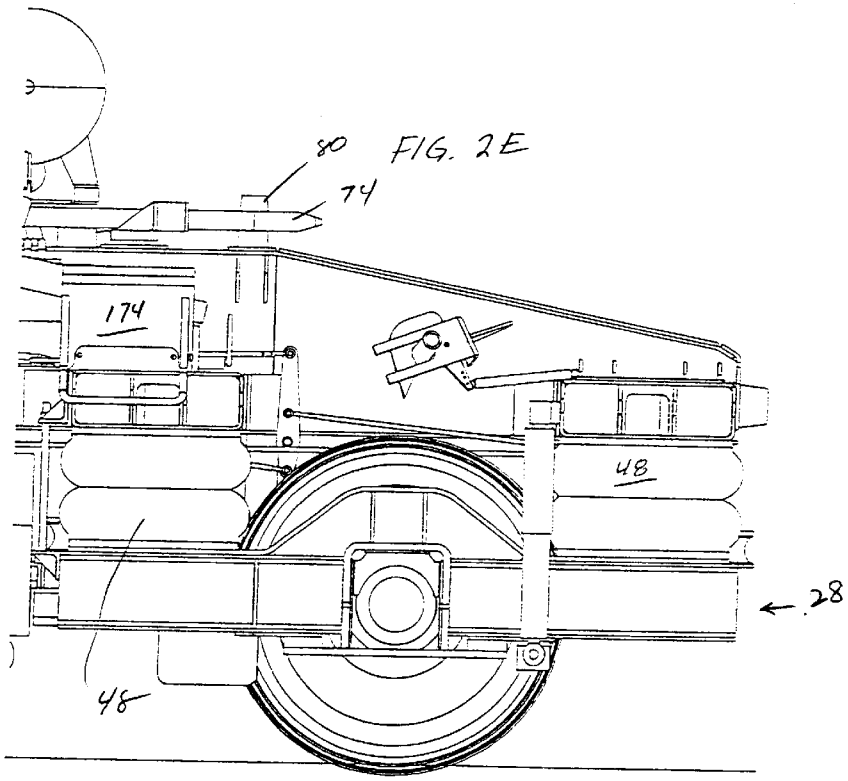
FIGS. 2E and 2F are partial views of the intermodal vehicle shown in FIG. 2C, FIG. 2E showing the vehicle in its fully raised position, and FIG. 2F showing the vehicle in its fully lowered position.
Figure 2F:
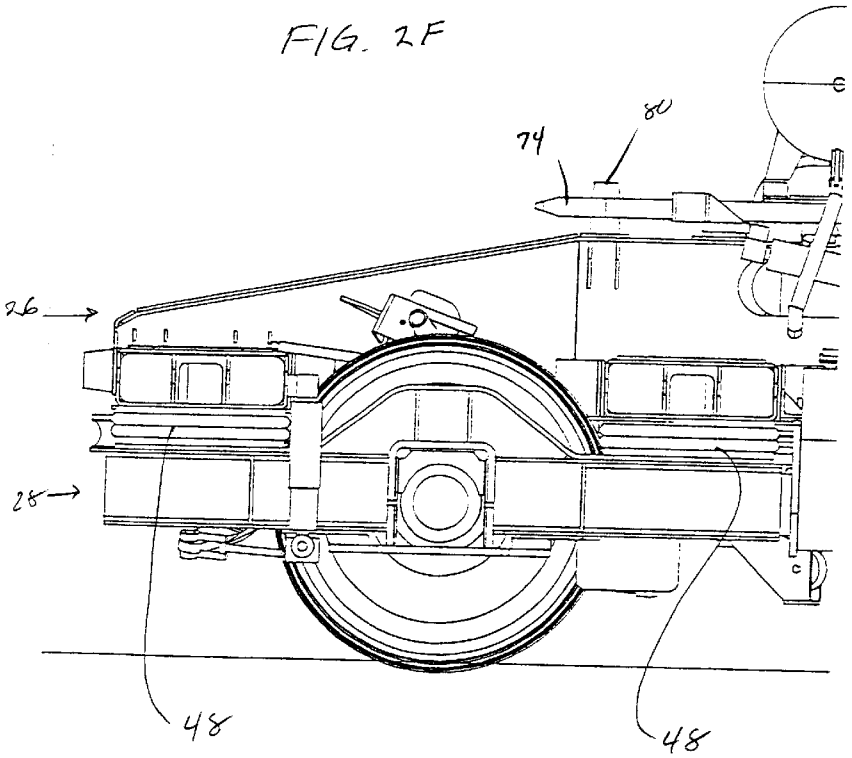

In order to prevent the upper frame weldment from moving above the position shown in FIG. 2E, over-extension rods 192 are provided. These rods are supported by upper and lower gusseted L-shaped brackets 194 which are welded to portions of the upper and lower frame assemblies 26, 28, and 30. When the upper frame is in its fully raised position, the nuts on the ends of the rods 192 will contact the L-shaped brackets limiting further upward movement. In addition, shock absorbers 196 are provided.

While not described above, it should be appreciated that the intermodal vehicle of this invention is provided with both mechanical brakes and air brakes. In addition, an air reservoir is provided in order that service air is available at all times.

TRAILER COUPLER

With reference now to FIGS. 14 and 15, the trailer coupler sockets of this invention have been redesigned to cooperate with the coupler pin 80 of this invention. The coupler socket 22 is illustrated in FIG. 14, but it should be appreciated that it is identical with the coupler socket 24. The coupler socket is open at one end, at the top in FIG. 14, and has tapered walls 100, 102, spaced equidistant away from the longitudinal centerline 104 of the coupler. The coupler socket is also provided with an inner vertically extending transverse wall 106 which limits the distance a drawbar can enter into the trailer coupler socket. It should be appreciated that if the drawbar were entering into the socket off centerline, that the tapered walls 100, 102 will center the drawbar so that the aperture 78 within the drawbar will positioned centrally so that it is generally in alignment with the upper and lower bushings 108, 110 of the coupler socket. The upper and lower bushings, best shown in FIG. 15, are welded or otherwise rigidly secured to upper and lower plates 112, 114 of the coupler socket. The upper bushing is provided with a frusto-conical aperture 108.1 which corresponds dimensionally to the frusto-conical upper end 80.2 of the coupler pin 80. The lower bushing is provided with an aperture 110.1 so sized that it snugly receives the cylindrical portion 80.1 of the coupler pin 80.

When the coupler socket has been properly positioned with respect to one end of the coupler tongue 74, the apertures 110.1 and 108.1 of the coupler socket will be in general alignment with the aperture 78 of the coupler tongue 78, which is also in general alignment with an aperture 116 in the top surface 118 of the upper frame weldment 26. As previously noted, the coupler pin 80 may be in its lowered position where its upper surface 80.3 is at approximately the same level as the upper surface of the wear plates 88, or spaced slightly below. To couple the end of the trailer to the intermodal vehicle it is only necessary to raise the coupler pin 80. Because it has a frusto-conical upper surface 80.2 it will attend to the final alignment of the trailer with coupler, the upper surface 80.2 initially passing through the aperture 110.1 in bushing 110, then through an aperture 78 in a bushing 122 received in the aperture in the drawbar, and then into the aperture 108.1 of bushing 108. The coupling pin 80 will come to rest when the upper end 80.2 is snugly received in the bushing 108.1. It should be noted that the aperture 78 of bushing 122 is of a special configuration. Thus, it has a central cylindrical portion 78.1 which snugly receives the cylindrical portion 80.1 of the coupling pin, and upper and lower frusto-conical surfaces 78.2 and 78.3, respectively.

Because of the specific design of the coupling pin and trailer sockets of this invention, the coupler pin can move with the trailer 95 and the trailer rocks about the intermodal vehicle 10 and as it pivots about the coupler pin 80. To this end, it should be noted that the apertures in plate 118 and wear plate 88 are sufficiently large as to permit movement of the end of the coupler pin which is within the apertures when the coupler pin 80 is in its raised position. In addition, the connection between the mounting bracket 82 and the bell crank provide a limited amount of movement from side to side and fore and aft. However, the apertures 108.1 and 110.1 snugly engage the frusto-conical upper end 80.2 and the lower cylindrical surface 80.1 of the coupler pin. Because of the specific design of the bushing within the tongue, the coupler pin can rock as the trailer rocks with respect to the upper frame weldment 26.

TRAIN MAKE-UP PROCEDURE

With reference now to FIGS. 1 and 2, an intermodal train of this invention is made-up in the following manner. Initially the hand brakes on the intermodal vehicle will be set, and the rear of trailer 12 will be pushed back onto the intermodal vehicle. During this operation the pair of longitudinally-extending, spaced-apart, centrally-located main frame 16 of the trailer will engage the right and left edges of the 128, 130 of the flared loading ramps 132, 134. In this connection, it can be seen that the loading surface 132, 134 is inclined upwardly and outwardly from the end. By inclining it upwardly, as the trailer is pushed over the upper surface it will be raised until the wheels 20 are approximately 2.5 inches off the ground when it supported by the upper horizontal surface of the upper frame assembly. Meanwhile the edges 128, 130 are engaged by the side rails to insure that the coupler socket 24 is properly positioned with respect to the coupler tongue. When the trailer is moved back sufficiently, it will engage rubber or rubber-like bumpers 136, 138 carried by gusseted plates 140, 142 which are in turn carried by a bar 144, the bar in turn being pivotally secured to the upper frame on a pivot post 146. As it is possible that the rear of the trailer may not be perpendicular with the intermodal vehicle, the bar 146 can pivot about the pivot post, and its movement can be restricted by a shock absorber 148 secured at one end to a bar extension 150, an at the other end to a suitable bracket 152 carried to one side of the upper frame assembly. After there is no further rearward movement of the trailer with respect to the intermodal vehicle 10, the coupler pin is raised to firmly secure the socket 24 to the associated end of the drawbar. The intermodal vehicle 10 and trailer 12 are now backed into the front end of trailer 14. To facilitate alignment, the landing gear is positioned within a suitable target area with respect to the rails so that the centerline of the trailer 14 is preferable within 2.5 inches of the centerline of the intermodal rail vehicle. As the intermodal vehicle moves towards the trailer 14 it will be caused to be raised as it slides upon the ramps 132, 134 until the couple tongue is fully received within the socket 22. The associated coupler pin is now raised to secure the trailer to the intermodal rail vehicle. As each trailer is provided with a suitable trailer air brake line, they are connected to the brake line of the intermodal rail vehicle. Now it is only necessary to raise the upper frame, which up to this point has been in its lowered position with respect to the lower frame in order to put the trailers into the rail transport mode. The foregoing steps will be completed with other intermodal rail vehicles and highway trailers until a suitable train is made up.

TRANSITION VEHICLE

The one embodiment of the transition vehicle of this invention is shown in FIGS. 22–25. The vehicle includes a steerable lower frame like the lower frame of the intermodal vehicle, and an upper frame 200 supported on the lower frames. The upper frame has a single drawbar 202 and a single coupler pin 204 for securing the coupler socket at one end of a highway trailer to the transition vehicle, there being an elongated ramp 206 between one end of the transition vehicle and the drawbar and coupler pin, so that the end of the trailer supported by the transition vehicle will be spaced beyond the midpoint of the upper frame for better operational balance. The other end of the transition vehicle carries a knuckle coupler 208 for coupling the transition vehicle to rail road equipment. While a knuckle coupler is shown, other forms of couplers could be used. As can best be seen from FIG. 25, the transition vehicle is used to support the front end of a highway trailer. The reason for this is that in the present design of the highway trailer it would not be possible to back up the rear of the trailer far enough without the highway wheels contacting the ramp end of the transition vehicle. Therefore, the front end of the trailer is mounted on the transition vehicle.

In the transition vehicle, only single convolution air bags are utilized to carry the upper frame as the highway wheels of the trailer are spaced away from the transition vehicle. Shock absorbers 210 may be utilized to stabilize the upper frame when the air bags are inflated.

Figure 26:
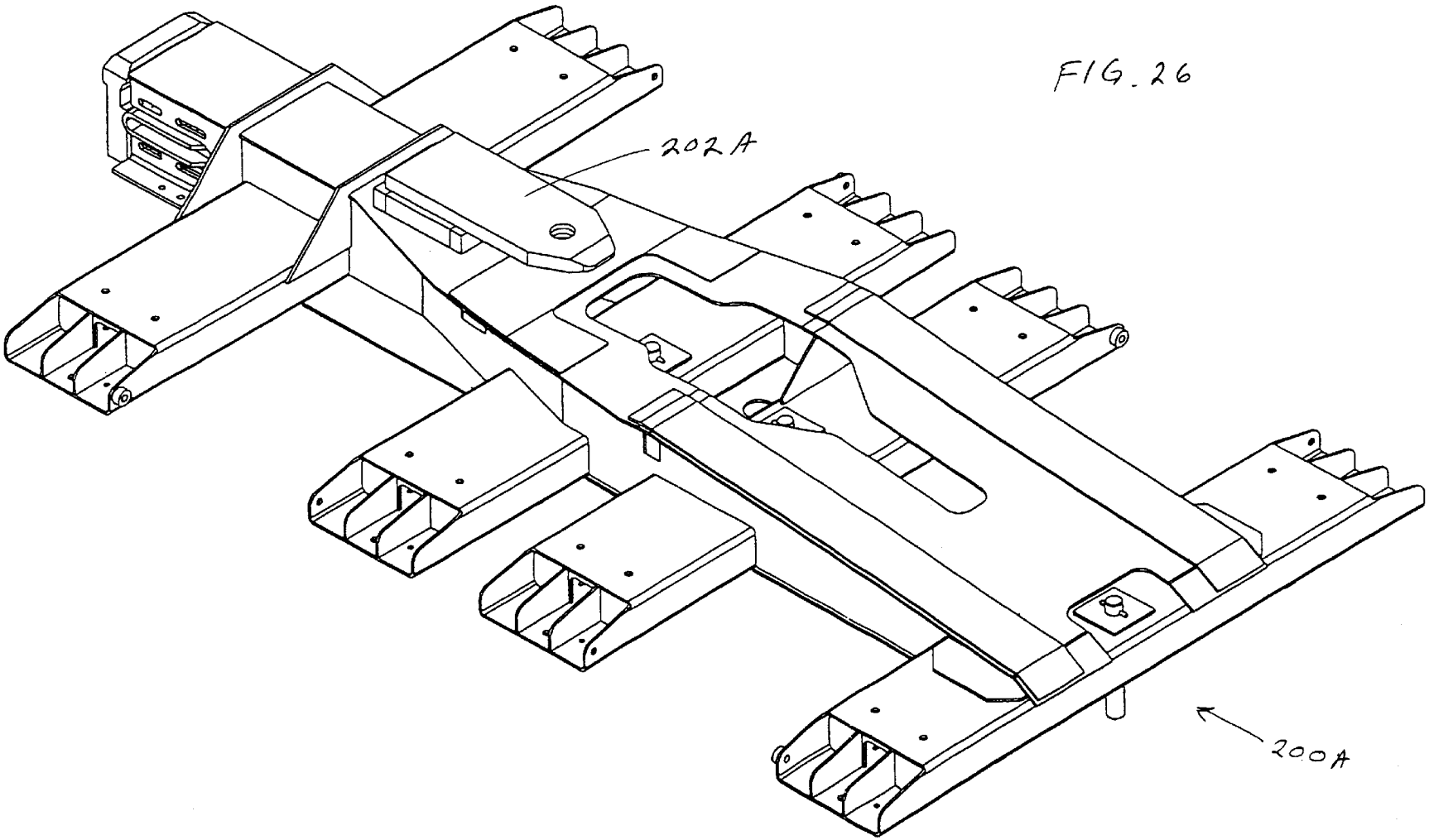
FIG. 26 is an isometric view of the upper frame assembly of an alternate design of transition vehicle.

In FIG. 26 a differing upper frame 200A is shown. This upper frame is similar in many respects, but the drawbar 202A is of a somewhat differing configuration.

It should be understood that applicant does not intend to be limited to the particular details described above and illustrated in the accompanying drawings and photographs. Thus, it is the desire of the inventors of the present invention that it be clearly understood that the embodiments of the invention, while preferred, can be readily changed and altered by one skilled in the art and that these embodiments are not to be limiting or constraining on the form or benefits of the invention.

What is claimed is:

1. A refined intermodal vehicle for forming a train of highway trailers including leading and trailing highway trailers which are interconnected to each other and supported by the intermodal vehicle for travel upon railroad tracks, each of the highway trailers including a leading coupler socket assembly at one end and a trailing coupler socket assembly at the other end, each intermodal vehicle having two rail wheel assemblies, lower frame assembly in which each of the two rail wheel assemblies are mounted, upper frame assembly supported on the lower frame assembly, the upper frame assembly including leading and trailing load carrying structures; characterized by the provision of a integral single-piece drawbar mounted on the upper frame assembly and extending above the leading and trailing load carrying structures, each end of the assembly of an associated highway trailer supported on an associated load carrying structure to connect the associated trailer to the intermodal vehicle.

2. The refined intermodal vehicle for forming a train of highway trailers as set forth in claim 1 wherein a shock absorbing trailer stop assembly is provided, the shock absorbing trailer stop assembly including a bar pivotally carried by the upper frame, and spaced apart rubber-like bumpers carried by the bar.

3. A refined intermodal vehicle for forming a train of highway trailers including leading and trailing highway trailers which are interconnected to each other and supported by the intermodal vehicle for travel upon railroad tracks, each intermodal vehicle having a pair of steerable lower frame assemblies in which two rail wheel assemblies are mounted, a unitary upper frame assembly supported on the lower frame assemblies, the upper frame assembly including leading and trailing load carrying structures; characterized by the provision of an improved steering mechanism extending between the unitary upper frame assembly and the steerable lower frame assemblies, the steering mechanism including vertically extending guide rods, there being at least one guide rod at each end of the upper frame assembly, and apertured plates interconnected with the steerable lower frame assemblies, each of the plates being mounted for spring resisted movement.

4. The refined intermodal vehicle for forming a train of highway trailers as set forth in claim 3 wherein each of the apertured plates is mounted on rubber or rubber-like shear blocks which are in turn secured to the associated lower frame assembly.

5. The refined intermodal vehicle for forming a train of highway trailers as set forth in claim 3 wherein there are a pair of vertically extending guide rods for each of the two lower frame assemblies, one guide rod being received by a mounting plate interconnected to the associated lower frame assembly at a leading end and the other vertically extending guide rod being received by a mounting plate interconnected to the associated lower frame assembly at a trailing end.

6. A refined intermodal vehicle for forming a train of highway trailers including leading and trailing highway trailers which are interconnected to each other and supported by the intermodal vehicle for travel upon railroad tracks, each of the highway trailers including a leading coupler socket assembly at one end and a trailing coupler socket assembly at the other end, and a pair of longitudinally extending spaced apart centrally located rails, each intermodal vehicle having two rail wheel assemblies, a lower frame assembly in which each of the two rail wheel assemblies are mounted, upper frame assembly supported on the lower frame assembly, the upper frame assembly including leading and trailing load carrying structures; characterized by a centering ramp on the upper frame structure having spaced apart diverging edges so that as one of the highway trailer is backed upon the intermodal vehicle the trailer will be ramped up, and as the longitudinal support rails of the trailer engage the edges of the centering ramp, the trailer will be centered on the intermodal vehicle.

7. A refined intermodal vehicle for forming a train of highway trailers including leading and trailing highway trailers which are interconnected to each other and supported by the intermodal vehicle for travel upon railroad tracks, each intermodal vehicle having two rail wheel assemblies, a lower frame assembly in which each of the two rail wheel assemblies are mounted, a unitary upper frame assembly supported on the lower frame assembly, and air spring means for supporting the upper frame assembly in raised and lowered positions with respect to the lower frame assembly; characterized by the provision of a backup suspension system for insuring the upper frame is maintained in its raised position when desired even in the event of a failure of the air springs, the backup suspension system including a plurality of coil springs, the unitary upper frame being provided with pockets in alignment with the coil springs, and shiftable means for uncovering the pockets when the upper frame is to be lowered, and for covering the pockets when the upper frame is to be maintained in its raised position.

8. A transition vehicle for coupling a train of intermodal vehicles and highway trailers to a conventional rail vehicle, each of the highway trailers including a leading coupler socket assembly at one end, each of the coupler sockets having spaced apart aligned apertures; the transition vehicle comprising:

a rail truck;

a load carrying support surface carried by the rail truck;

an apertured coupler tongue carried by the rail truck in a position above the load carrying support surface;

a coupler pin carried by the rail truck and which may pass though the aperture in the coupler tongue and the aligned apertures in the associated coupler socket to secure the leading end of the highway trailer to the transition vehicle; and a forwardly extending rail coupler which may be used to couple the transition vehicle to a rail vehicle.

* * * * *

UNITED STATES PATENT AND TRADEMARK OFFICE

CERTIFICATE OF CORRECTION

PATENT NO. : 6,393,996 B1 
DATED : May 28, 2002
INVENTOR(S) : Virgil E. Duncan et al.

It is certified that error appears in the above-identified patent and that said Letters Patent is hereby corrected as shown below:

Column 10,
Line 48, -- single piece drawbar capable of being received within a coupler socket -- should be inserted after "each end of the".

Signed and Sealed this

Eighth Day of April, 2003

JAMES E. ROGAN
*Director of the United States Patent and Trademark Office*